US012433391B2

(12) United States Patent
Cornish et al.

(10) Patent No.: US 12,433,391 B2
(45) Date of Patent: Oct. 7, 2025

(54) COLLAPSIBLE AND EXTENDABLE DEVICE GRIP

(71) Applicant: Otter Products, LLC, Fort Collins, CO (US)

(72) Inventors: Joshua R. Cornish, Fort Collins, CO (US); W. Travis Smith, Fort Collins, CO (US); Andrew J. Walla, Aurora, CO (US); Cameron D. Magness, Fort Collins, CO (US)

(73) Assignee: Otter Products, LLC, Fort Collins, CO (US)

( * ) Notice: Subject to any disclaimer, the term of this patent is extended or adjusted under 35 U.S.C. 154(b) by 852 days.

(21) Appl. No.: 17/697,731

(22) Filed: Mar. 17, 2022

(65) Prior Publication Data

US 2022/0304457 A1 Sep. 29, 2022

Related U.S. Application Data

(60) Provisional application No. 63/272,480, filed on Oct. 27, 2021, provisional application No. 63/234,551, (Continued)

(51) Int. Cl.

| | |
|---|---|
| ***A45F 5/10*** | (2006.01) |
| ***A45C 11/00*** | (2006.01) |
| ***A45F 5/00*** | (2006.01) |

(52) U.S. Cl.

CPC ..... *A45F 5/10* (2013.01); *A45C 11/00* (2013.01); *A45C 11/002* (2025.01); *A45C 2200/15* (2013.01); *A45F 5/1516* (2025.01)

(58) Field of Classification Search

CPC ..... A45C 11/00; A45C 11/002; A45C 11/003; A45C 2200/15; A45F 5/00; A45F 5/10; (Continued)

(56) References Cited

U.S. PATENT DOCUMENTS 1,495,752 A * 5/1924 La Rue ..... A45C 13/22 190/115
2,242,283 A * 5/1941 Avery ..... A45C 13/26 16/405

(Continued)

FOREIGN PATENT DOCUMENTS

CN 202488509 U 10/2012
FR 935529 A 6/1948

(Continued)

*Primary Examiner* — Bao-Thieu L Nguyen

(57) ABSTRACT

A grip system comprises a protective case and a grip apparatus. The grip apparatus is removably attachable to a back surface of the protective case. The grip apparatus includes a base, two flexible strips or straps, and a cap. The base is configured to be removably inserted into the recess in the back of the protective case. The two flexible strips are each attached to the base. The cap is proximate a top surface of the base when in a stowed position and extendable away from the top surface of the base when the cap is pulled outward to an extended position. Each flexible strip is configured or adapted to slide within a slot or channel in the cap. Each flexible strip slides into the slot when the grip apparatus is transitioned to the stowed position and slides out of the slot when transitioned to the extended position.

17 Claims, 31 Drawing Sheets

Related U.S. Application Data filed on Aug. 18, 2021, provisional application No. 63/190,869, filed on May 20, 2021, provisional application No. 63/167,198, filed on Mar. 29, 2021.

(58) Field of Classification Search
CPC . A45F 5/1516; A45F 5/1252; A45F 2005/008
See application file for complete search history.

(56) References Cited

U.S. PATENT DOCUMENTS 2,374,629 A * 4/1945 Thiele ..... A45C 13/26 16/405
3,023,885 A 3/1962 Kindseth
3,113,651 A * 12/1963 Szabo ..... A45C 13/22 16/405
3,168,173 A * 2/1965 Koffler ..... A45C 13/26 16/405
3,275,336 A * 9/1966 Warner, Jr. ..... A45C 13/30 280/43.24
3,289,798 A * 12/1966 Gehrie ..... A45C 13/26 190/115
3,372,780 A * 3/1968 Fujioka ..... A45C 13/26 16/405
3,480,310 A 11/1969 Mcelwain
3,521,216 A 7/1970 Tolegian
3,786,391 A 1/1974 Mathauser
3,808,577 A 4/1974 Mathauser
3,810,258 A 5/1974 Mathauser
3,816,679 A 6/1974 Hotchkiss
4,029,999 A 6/1977 Neumann et al.
4,066,155 A * 1/1978 Buchek ..... A45C 13/22 D3/274
4,097,878 A 6/1978 Cramer
4,182,558 A 1/1980 Matsuo
4,431,333 A 2/1984 Chandler
4,584,718 A 4/1986 Fuller
4,856,658 A 8/1989 Novak
4,859,110 A 8/1989 Dommel
4,925,146 A 5/1990 Hegarty
4,933,988 A 6/1990 Thibault
4,940,414 A 7/1990 Lee
4,963,902 A 10/1990 Fukahori
4,981,243 A 1/1991 Rogowski
4,994,829 A 2/1991 Tsukamoto
5,025,921 A 6/1991 Gasparaitis et al.
5,054,733 A 10/1991 Shields
5,123,044 A 6/1992 Tate
5,138,523 A 8/1992 Benck et al.
5,359,756 A 11/1994 Miyauchi et al.
5,360,108 A 11/1994 Alagia
5,368,159 A 11/1994 Doria
5,380,968 A 1/1995 Morse
5,383,091 A 1/1995 Snell
5,386,084 A 1/1995 Risko
5,388,691 A 2/1995 White
5,388,692 A 2/1995 Withrow et al.
5,508,479 A 4/1996 Schooley
5,541,813 A 7/1996 Satoh et al.
5,604,050 A 2/1997 Brunette et al.
5,664,292 A 9/1997 Chen
5,671,120 A 9/1997 Kikinisi
5,992,807 A 11/1999 Tarulli
5,996,956 A 12/1999 Shawver
6,032,334 A * 3/2000 Iima ..... A45C 13/26 16/444
6,082,771 A * 7/2000 Long ..... B42F 13/00 294/138
6,097,593 A 8/2000 Faranda et al.
6,115,248 A 9/2000 Canova et al.
6,135,408 A 10/2000 Richter
6,149,116 A 11/2000 Won
6,151,206 A 11/2000 Kato et al.
6,302,617 B1 10/2001 Rumpp
6,305,588 B1 10/2001 Michel et al.
6,305,656 B1 10/2001 Wemyss
6,311,017 B1 10/2001 Mori
6,317,313 B1 11/2001 Mosgrove et al.
6,349,824 B1 2/2002 Yamada
6,375,009 B1 4/2002 Lee
6,409,531 B1 6/2002 Millard
6,445,577 B1 9/2002 Madsen et al.
6,456,487 B1 9/2002 Hetterick
6,464,524 B1 10/2002 Kerr et al.
6,490,155 B2 12/2002 Han et al.
6,514,624 B2 2/2003 Takemoto
6,545,862 B1 4/2003 Gettemy et al.
6,616,111 B1 9/2003 White
6,625,394 B2 9/2003 Smith et al.
6,626,362 B1 9/2003 Steiner et al.
6,646,864 B2 11/2003 Richardson
6,685,493 B2 2/2004 Birkenmaier et al.
6,701,159 B1 3/2004 Powell
6,705,580 B1 3/2004 Bain
6,762,935 B2 7/2004 Hidewasa
6,865,076 B2 3/2005 Lunsford
6,888,940 B1 5/2005 Deppen
6,966,519 B2 11/2005 Salentine et al.
7,050,841 B1 5/2006 Onda
7,072,699 B2 7/2006 Eiden
7,145,767 B2 12/2006 Mache et al.
7,158,376 B2 1/2007 Richardson et al.
7,180,735 B2 2/2007 Thomas et al.
7,194,291 B2 3/2007 Peng
7,230,823 B2 6/2007 Richardson et al.
7,236,588 B2 6/2007 Gartrell
7,287,738 B2 10/2007 Pitlor
7,311,526 B2 12/2007 Rohrbach et al.
7,343,184 B2 3/2008 Rostami
7,359,184 B2 4/2008 Lord
7,374,142 B2 5/2008 Carnevali
7,431,251 B2 10/2008 Carnevali
7,555,325 B2 6/2009 Goros
7,558,594 B2 7/2009 Wilson
7,575,389 B2 8/2009 Nance
7,661,567 B2 2/2010 Myers
7,688,580 B2 3/2010 Richardson et al.
7,712,590 B1 * 5/2010 Lee ..... A45C 13/26 16/110.1
7,845,608 B1 12/2010 Chen et al.
7,871,218 B2 1/2011 Frey et al.
7,889,489 B2 2/2011 Richardson et al.
7,907,394 B2 3/2011 Richardson et al.
7,933,122 B2 4/2011 Richardson et al.
8,016,107 B2 9/2011 Emsky
8,049,727 B2 11/2011 Hanson et al.
8,204,561 B2 6/2012 Mongan et al.
8,303,336 B2 11/2012 Smith
8,442,604 B1 5/2013 Diebel
8,453,297 B2 * 6/2013 Wang ..... G06F 1/1656 190/115
8,453,344 B2 6/2013 Nishiwaki et al.
8,453,835 B2 6/2013 So
8,457,701 B2 6/2013 Diebel
8,485,329 B1 * 7/2013 Roy ..... G01G 19/58 177/149
8,490,783 B1 7/2013 Fan
8,509,865 B1 8/2013 LaColla et al.
8,514,568 B2 8/2013 Qiao et al.
8,550,317 B2 10/2013 Hyseni
8,560,031 B2 10/2013 Barnett et al.
8,567,599 B2 10/2013 Beatty et al.
8,599,547 B2 12/2013 Richardson et al.
8,608,502 B2 12/2013 Witter et al.
8,646,739 B2 2/2014 Moyer
8,676,281 B1 3/2014 Caulder et al.
8,706,175 B2 4/2014 Cho
8,737,066 B1 5/2014 Block
8,755,852 B2 6/2014 Hynecek et al.
8,770,402 B2 7/2014 Bergreen et al.
8,777,002 B2 7/2014 Thomas et al.
8,794,686 B2 8/2014 Grieve
8,798,675 B2 8/2014 Salmon et al.
8,800,762 B2 8/2014 Fathollahi

(56) References Cited

U.S. PATENT DOCUMENTS 8,830,663 B2 9/2014 Child et al.
8,844,098 B2 9/2014 Karmatz
8,875,879 B2 11/2014 Diebel et al.
8,955,678 B2 2/2015 Murphy et al.
8,965,458 B2 2/2015 Richardson et al.
8,978,883 B2 * 3/2015 Gandhi ..... A45C 11/00 206/45.24
9,008,738 B1 4/2015 Dong
9,060,580 B2 6/2015 Tages
9,060,591 B1 * 6/2015 White ..... A45F 5/10
9,089,056 B2 7/2015 Rayner
9,098,238 B2 8/2015 Richardson et al.
9,125,297 B2 9/2015 Magness
9,136,897 B2 9/2015 Hynecek et al.
9,153,112 B1 10/2015 Kiani et al.
9,226,057 B1 12/2015 Davis et al.
9,266,664 B2 2/2016 Bau
9,274,556 B2 3/2016 Gallouzi et al.
9,295,174 B2 3/2016 Witter et al.
9,301,584 B2 4/2016 Butts
9,316,026 B2 4/2016 Myers et al.
9,316,344 B2 4/2016 Gette et al.
9,367,090 B2 6/2016 Barnett et al.
9,377,154 B2 6/2016 Hung et al.
9,397,719 B1 7/2016 Schmidt
9,408,448 B2 8/2016 Kay et al.
9,462,099 B2 10/2016 Wilson et al.
9,470,358 B2 10/2016 Gette et al.
9,481,490 B2 11/2016 Venida et al.
9,487,376 B2 11/2016 Salentine et al.
9,503,147 B2 11/2016 Witter et al.
9,535,453 B2 * 1/2017 Dong ..... G06F 1/1626
9,537,526 B2 1/2017 Wilson et al.
9,538,675 B2 1/2017 Gette et al.
9,545,140 B1 1/2017 Johnson et al.
9,615,476 B2 4/2017 Rayner et al.
9,622,556 B2 4/2017 Fathollahi et al.
9,654,605 B2 5/2017 Goldfain et al.
9,660,684 B2 5/2017 Rayner
9,743,540 B2 8/2017 Magness
9,765,921 B2 9/2017 Vogel et al.
9,774,713 B2 9/2017 Guerdrum et al.
9,787,348 B2 10/2017 Srour
9,788,620 B1 10/2017 Parkinson
9,800,283 B2 10/2017 Schmidt
9,806,549 B2 10/2017 Liberti et al.
9,807,211 B2 10/2017 Guerdrum et al.
9,851,758 B2 12/2017 Rowley
9,871,550 B2 1/2018 Witter et al.
9,887,726 B1 2/2018 Mchatet
9,894,192 B2 2/2018 Cox, I
9,913,388 B1 3/2018 Mchatet
9,930,943 B2 4/2018 Lach et al.
9,980,548 B1 * 5/2018 Lai ..... A45C 13/26
10,019,034 B2 7/2018 Barnett et al.
10,027,783 B2 7/2018 Dukerschein et al.
10,030,807 B1 7/2018 Hobbs et al.
10,054,259 B2 8/2018 Hobbs et al.
10,058,155 B2 8/2018 Guerdrum et al.
10,060,573 B2 8/2018 Hobbs et al.
10,063,272 B1 * 8/2018 Yeo ..... A45F 5/00
10,103,769 B2 10/2018 Witter et al.
10,113,691 B2 10/2018 Grieve
10,136,716 B2 11/2018 Northrup et al.
10,178,903 B2 1/2019 Guerdrum et al.
10,200,518 B2 2/2019 Richter
10,206,472 B1 2/2019 Northrup et al.
10,244,854 B1 4/2019 Haber et al.
10,278,299 B2 4/2019 Kim
10,348,352 B2 7/2019 Barnett et al.
10,349,728 B2 * 7/2019 Yoo ..... A45F 5/10
10,386,009 B2 8/2019 Hobbs et al.
10,389,860 B2 8/2019 Nahum et al.
10,413,027 B1 9/2019 Olson et al.
10,463,116 B2 11/2019 Barnett et al.
10,484,522 B1 11/2019 Mchatet
10,530,411 B2 1/2020 Gehlhausen et al.
10,610,004 B1 * 4/2020 Yeo ..... A45F 5/10
10,624,443 B2 4/2020 Haber et al.
10,655,775 B2 5/2020 Hobbs et al.
10,694,835 B2 6/2020 Peterson et al.
10,742,251 B2 8/2020 Barnett et al.
D894,889 S * 9/2020 Feller ..... D14/251
10,953,535 B2 3/2021 Karmatz
11,161,649 B2 * 11/2021 Silsby ..... B65D 25/28
11,553,771 B2 * 1/2023 Yoon ..... H04B 1/385
2001/0000617 A1 5/2001 Tracy
2001/0034923 A1 * 11/2001 Ho ..... A45C 13/26 16/114.1
2001/0054594 A1 12/2001 Maier-Hunke
2002/0065054 A1 5/2002 Humphreys et al.
2002/0079244 A1 6/2002 Kwong
2003/0141329 A1 7/2003 Huang
2004/0029405 A1 2/2004 Neidlein
2004/0150945 A1 8/2004 Mache et al.
2004/0182667 A1 * 9/2004 Lin ..... A45C 13/26 190/115
2005/0088811 A1 4/2005 Ulla et al.
2005/0213298 A1 9/2005 Doherty et al.
2005/0224508 A1 10/2005 Tajiri et al.
2005/0279661 A1 12/2005 Hodges
2005/0284904 A1 12/2005 Knapp et al.
2006/0027718 A1 2/2006 Quijano et al.
2006/0066438 A1 3/2006 Altounian et al.
2006/0086873 A1 4/2006 Chen
2006/0172765 A1 8/2006 Lev
2006/0237495 A1 10/2006 Chen et al.
2006/0243679 A1 11/2006 Dickerson
2006/0255493 A1 11/2006 Fouladpour
2007/0071423 A1 3/2007 Fantone et al.
2007/0115387 A1 5/2007 Ho
2007/0146985 A1 6/2007 Mick et al.
2007/0155448 A1 7/2007 Hong
2007/0158220 A1 7/2007 Cleereman et al.
2007/0181620 A1 8/2007 Carver
2007/0215659 A1 9/2007 Knapp et al.
2007/0215769 A1 9/2007 Nebeker et al.
2007/0297149 A1 12/2007 Richardson et al.
2008/0083797 A1 4/2008 Myers
2008/0117578 A1 5/2008 Moscovitch
2008/0163463 A1 7/2008 Hulden
2008/0199252 A1 8/2008 Frey et al.
2008/0304692 A1 12/2008 Zhang
2009/0001232 A1 1/2009 Seo et al.
2009/0034169 A1 2/2009 Richardson et al.
2009/0079665 A1 3/2009 Moscovitch
2009/0084705 A1 4/2009 Justiss
2009/0161903 A1 6/2009 White
2009/0237377 A1 9/2009 Lai et al.
2009/0283184 A1 11/2009 Han
2010/0006468 A1 1/2010 Lin
2010/0078343 A1 4/2010 Hoellwarth et al.
2010/0090085 A1 4/2010 Corrion
2010/0093412 A1 4/2010 Serra et al.
2010/0122756 A1 5/2010 Longinotti-Buitoni
2010/0141864 A1 6/2010 Lai
2010/0147737 A1 6/2010 Richardson et al.
2010/0181450 A1 7/2010 Hulick et al.
2010/0195279 A1 8/2010 Michael
2010/0203931 A1 8/2010 Hynecek et al.
2010/0215188 A1 8/2010 Wilcox
2010/0230301 A1 9/2010 Fellig
2010/0301717 A1 * 12/2010 Wang ..... G06F 1/1616 312/223.1
2011/0031287 A1 2/2011 Gette et al.
2011/0064401 A1 3/2011 DeSorbo
2011/0073505 A1 3/2011 Stiehl
2011/0073608 A1 3/2011 Richardson et al.
2011/0075349 A1 3/2011 Ma et al.
2011/0101058 A1 5/2011 Heckman
2011/0170256 A1 7/2011 Lee
2011/0192857 A1 8/2011 Rothbaum et al.
2011/0216495 A1 9/2011 Marx
2011/0228459 A1 9/2011 Richardson et al.

(56) References Cited

U.S. PATENT DOCUMENTS

2011/0235846 A1 9/2011 Jiang et al.
2011/0294556 A1 12/2011 Carlberg et al.
2011/0297566 A1 12/2011 Gallagher et al.
2011/0309117 A1* 12/2011 Roberts ..... H04B 1/3888 224/217
2011/0314651 A1 12/2011 Behar et al.
2012/0018325 A1 1/2012 Kim
2012/0031788 A1 2/2012 Mongan et al.
2012/0037524 A1 2/2012 Thomas et al.
2012/0037536 A1 2/2012 Thomas et al.
2012/0043235 A1 2/2012 Klement
2012/0074005 A1 3/2012 Johnson et al.
2012/0092377 A1 4/2012 Stein
2012/0104185 A1 5/2012 Carroll
2012/0106069 A1 5/2012 Strauser
2012/0111881 A1 5/2012 Gaddis et al.
2012/0118770 A1 5/2012 Valls et al.
2012/0170194 A1 7/2012 Lord et al.
2012/0175474 A1 7/2012 Barnard et al.
2012/0187260 A1 7/2012 Moyer
2012/0228346 A1 9/2012 Huang
2012/0252543 A1 10/2012 Cho
2012/0267491 A1 10/2012 Chiu
2012/0287565 A1 11/2012 Bennett
2012/0325702 A1 12/2012 Gallagher et al.
2012/0326003 A1 12/2012 Solow et al.
2013/0027862 A1 1/2013 Rayner
2013/0039521 A1 2/2013 Zhou et al.
2013/0068915 A1 3/2013 Yang
2013/0083953 A1 4/2013 Chang
2013/0088813 A1 4/2013 Su et al.
2013/0098788 A1 4/2013 McCarville et al.
2013/0107449 A1 5/2013 Su et al.
2013/0109253 A1 5/2013 Gammon et al.
2013/0117487 A1 5/2013 Leung
2013/0126533 A1 5/2013 Klosky
2013/0175186 A1 7/2013 Simmer
2013/0177181 A1 7/2013 Marcus
2013/0181584 A1 7/2013 Whitten et al.
2013/0220841 A1 8/2013 Yang
2013/0220847 A1 8/2013 Fisher et al.
2013/0222989 A1 8/2013 Chen
2013/0230202 A1 9/2013 Widner et al.
2013/0240578 A1 9/2013 Yu
2013/0262248 A1 10/2013 Kim et al.
2013/0292269 A1 11/2013 Tages
2013/0292288 A1 11/2013 Willes
2013/0303000 A1 11/2013 Witter et al.
2013/0318775 A1 12/2013 Peters
2014/0003647 A1 1/2014 Liu
2014/0049142 A1 2/2014 Magness
2014/0065847 A1 3/2014 Salmon et al.
2014/0080553 A1 3/2014 Torset et al.
2014/0097102 A1 4/2014 Piatt et al.
2014/0099526 A1 4/2014 Powell et al.
2014/0128132 A1 5/2014 Cox, I
2014/0141838 A1 5/2014 Cai et al.
2014/0152890 A1 6/2014 Rayner
2014/0166707 A1 6/2014 Leisey-Bartsch
2014/0168884 A1 6/2014 Wylie
2014/0183064 A1 7/2014 Ge
2014/0183065 A1 7/2014 Toulotte
2014/0187289 A1 7/2014 Cataldo et al.
2014/0200056 A1 7/2014 Liu
2014/0227026 A1 8/2014 O'Neill et al.
2014/0228074 A1 8/2014 Kulkarni et al.
2014/0262848 A1 9/2014 Fathollahi et al.
2014/0262934 A1 9/2014 Fathollahi et al.
2014/0265765 A1 9/2014 Khodapanah et al.
2014/0265767 A1 9/2014 Fathollahi
2014/0299488 A1 10/2014 Andrew
2014/0302896 A1 10/2014 Xu et al.
2014/0325818 A1 11/2014 Mayfield
2014/0355200 A1 12/2014 Thiers
2014/0375877 A1 12/2014 Tages et al.
2015/0061477 A1 3/2015 Wilson
2015/0062787 A1 3/2015 Wilson et al.
2015/0068935 A1 3/2015 Kay et al.
2015/0083615 A1 3/2015 Lay et al.
2015/0111623 A1 4/2015 Hegemier et al.
2015/0133183 A1 5/2015 Alameh et al.
2015/0141090 A1 5/2015 Hwan et al.
2015/0141095 A1 5/2015 Kim
2015/0153791 A1 6/2015 Wong
2015/0172431 A1 6/2015 Huang
2015/0189160 A1 7/2015 Auger et al.
2015/0194997 A1 7/2015 Johnson et al.
2015/0194998 A1 7/2015 Fathollahi
2015/0195938 A1 7/2015 Witter et al.
2015/0201723 A1 7/2015 Rayner et al.
2015/0214989 A1 7/2015 Yeh et al.
2015/0220766 A1 8/2015 Russell et al.
2015/0257285 A1 9/2015 Wilson et al.
2015/0257287 A1 9/2015 Tages
2015/0304466 A1 10/2015 Tamatsu
2015/0335138 A1 11/2015 Juarbe
2016/0007705 A1 1/2016 Liebers et al.
2016/0036478 A1 2/2016 Wong
2016/0040825 A1 2/2016 Franklin
2016/0045005 A1 2/2016 Richardson et al.
2016/0072933 A1 3/2016 Cox, I
2016/0080024 A1 3/2016 Wilson et al.
2016/0122821 A1 5/2016 Liu et al.
2016/0142093 A1 5/2016 Phang
2016/0150861 A1 6/2016 Yao et al.
2016/0157368 A1* 6/2016 Dong ..... G06F 1/1626 361/679.01
2016/0164565 A1 6/2016 Witter et al.
2016/0179143 A1 6/2016 Bidwell et al.
2016/0183392 A1 6/2016 Kelley
2016/0195898 A1 7/2016 Lau
2016/0198822 A1 7/2016 Lee et al.
2016/0254836 A1 9/2016 Alsberg et al.
2016/0261133 A1 9/2016 Wang
2016/0282905 A1 9/2016 Aine et al.
2016/0286920 A1 10/2016 Ean et al.
2016/0286921 A1 10/2016 Northrup et al.
2016/0295981 A1 10/2016 Lay et al.
2016/0345715 A1 12/2016 Lin et al.
2016/0347257 A1 12/2016 Buchanan
2017/0026498 A1 1/2017 Goldfain et al.
2017/0041037 A1 2/2017 Witter et al.
2017/0099922 A1 4/2017 Guerdrum et al.
2017/0099924 A1 4/2017 Fathollahi et al.
2017/0119120 A1 5/2017 Richardson et al.
2017/0195000 A1 7/2017 Srour
2017/0237460 A1 8/2017 Rayner
2017/0253380 A1* 9/2017 Boyer ..... B65D 43/0225
2017/0279478 A1 9/2017 Fathollahi
2017/0327054 A1 11/2017 Yu et al.
2017/0328514 A1 11/2017 Cavalcante
2017/0328517 A1 11/2017 Wessels
2017/0353208 A1 12/2017 Wilson et al.
2017/0359096 A1 12/2017 Witter et al.
2017/0360200 A1 12/2017 Cohen
2018/0013463 A1 1/2018 Jeon
2018/0101197 A1 4/2018 Barnett et al.
2018/0136695 A1 5/2018 Lo et al.
2018/0167498 A1 6/2018 Drakos
2018/0369599 A1 12/2018 Smith
2019/0055062 A1* 2/2019 Winn ..... B65D 23/104
2019/0094853 A1 3/2019 Overall
2019/0104623 A1 4/2019 Backus
2019/0141848 A1 5/2019 Sung
2019/0208046 A1 7/2019 Gluck
2019/0211966 A1 7/2019 Nahum et al.
2019/0212774 A1 7/2019 Patterson et al.
2019/0215387 A1 7/2019 Chiang
2019/0222682 A1 7/2019 Ren et al.
2019/0225378 A1 7/2019 Barnett
2019/0229763 A1 7/2019 Nebel et al.
2019/0243421 A1 8/2019 Bamett et al.
2019/0245960 A1 8/2019 Nahum et al.
2019/0250664 A1 8/2019 Eslava et al.

(56) References Cited

U.S. PATENT DOCUMENTS

| | | | | |
|---|---|---|---|---|
| 2019/0278327 | A1 | 9/2019 | Barnett et al. | |
| 2019/0278328 | A1 | 9/2019 | Barnett et al. | |
| 2019/0281147 | A1 | 9/2019 | Sherburne et al. | |
| 2019/0281960 | A1 | 9/2019 | Peterson et al. | |
| 2019/0281961 | A1 | 9/2019 | Peterson et al. | |
| 2019/0286191 | A1 | 9/2019 | Correll, Jr. | |
| 2019/0335030 | A1 | 10/2019 | Nahum et al. | |
| 2019/0335031 | A1 | 10/2019 | Nahum et al. | |
| 2019/0350352 | A1* | 11/2019 | Chou | A45F 5/102 |
| 2021/0153635 | A1* | 5/2021 | Vasquez | A45F 5/00 |
| 2021/0250056 | A1* | 8/2021 | Sung | A45F 5/10 |
| 2021/0314430 | A1 | 10/2021 | Backus | |
| 2023/0044185 | A1* | 2/2023 | Troy | A45F 5/1516 |
| 2023/0189970 | A1* | 6/2023 | Cornish | A45C 11/00<br>294/171 |

FOREIGN PATENT DOCUMENTS

| | | | |
|---|---|---|---|
| KR | 200446444 | | 10/2009 |
| KR | 101394285 | | 5/2014 |
| KR | 102025187 | B1 | 9/2019 |
| WO | 1994000037 | A1 | 1/1994 |
| WO | 1999041958 | A1 | 8/1999 |
| WO | 2015103599 | A1 | 7/2015 |

* cited by examiner

COLLAPSIBLE AND EXTENDABLE DEVICE GRIP

CROSS REFERENCE TO RELATED APPLICATIONS

This application claims priority to U.S. Provisional Patent Application No. 63/167,198, filed Mar. 29, 2021, U.S. Provisional Patent Application No. 63/190,689, filed May 20, 2021, U.S. Provisional Patent Application No. 63/234,551, filed Aug. 18, 2021, and U.S. Provisional Patent Application No. 63/272,480, filed Oct. 27, 2021, which are all hereby incorporated by reference in their entireties.

BACKGROUND

Electronic devices, particularly portable electronic devices, are used for a growing variety of purposes, as well as in a growing variety of situations. Examples of portable electronic devices include smartphones, tablet computers, gaming devices, audio players, video players, cameras, portable computers, two-way radios, GPS receivers, and/or other electronic devices which are used in a mobile manner. Portable electronic devices are susceptible to damage from a variety of forces or elements such as dropping, impact, water, and scratching. At the same time, the cost of portable electronic devices is increasing. Improved apparatuses and techniques for protecting and securely holding portable and personal electronic devices are needed for better accommodating these changing use models.

SUMMARY

In one exemplary embodiment, a grip apparatus for facilitating holding of an electronic device comprises a base, two extension arms, and a cap. The base has at least a bottom surface and a top surface, wherein the bottom surface is configured for attachment to the electronic device or to a protective case for the electronic device, wherein the base includes two linear channels between the top surface and the bottom surface, wherein the base further includes two apertures in the top surface, wherein each aperture extends from the top surface of the base to a respective one of the linear channels. The two extension arms are each formed from a semi-rigid bendable material, wherein each extension arm includes first and second ends and is configured to slide, at least partially, within a respective one of the linear channels, wherein the first end of each extension arm extends through a respective one of the apertures in the top surface of the base, wherein each extension arm is configured to extend out of the aperture to an extended position and retract into the respective one of the linear channels to a retracted position when the extension arm slides within the linear channel, and wherein a stop at the second end of each extension arm establishes a maximum extension length and prevents the extension arm from fully exiting the linear channel through the respective aperture when at the extended position. The cap is attached to the first end of each extension arm, wherein the cap is configured to rest against one or more fingers of a user holding the electronic device, wherein the cap is proximate the top surface of the base when the extension arms are in the retracted positions, and wherein the cap and the extension arms extend away from the top surface of the base in a substantially perpendicular direction when the cap is pulled outward and the extension arms moved toward the extended positions.

In another exemplary embodiment, a grip device for facilitating holding of an electronic device includes at least a base, two arms, and a cap. The base has a bottom surface and a top surface, wherein the bottom surface is adapted for attachment to the electronic device or for attachment to a protective case for the electronic device, wherein the base includes two slots and two apertures at the top surface, wherein each aperture extends from the top surface of the base into a respective one of the slots. The two arms are each formed from a bendable material, wherein each arm includes first and second ends and is adapted to slide, at least partially, within a respective one of the slots, wherein the first end of each arm extends through a respective one of the apertures in the top surface of the base, wherein each arm is adapted to extend out of the aperture to an extended position and retract into the respective one of the slots to a retracted position when the arm slides within the respective slot, and wherein a stop at the second end of each arm establishes a maximum extension length and prevents the arm from fully exiting the slot through the respective aperture. The cap is attached to the first end of each arm, wherein the cap is adapted to assist a user in holding the electronic device, wherein the cap is proximate the top surface of the base when the arms are in the retracted positions, and wherein the cap and the arms extend away from the top surface of the base in a substantially perpendicular direction when the cap is pulled outward and the arms transition to the extended positions.

In another exemplary embodiment, a protective case for an electronic device includes or comprises a protective shell for receiving the electronic device, two arms, and a cap. The protective case covers at least a portion of a housing of the electronic device, wherein the protective shell includes two internal slots and two apertures at a back surface of the protective shell, wherein each aperture extends from the back surface into a respective one of the slots. The two arms are each formed from a bendable material, wherein each arm includes first and second ends and is adapted to slide, at least partially, within a respective one of the slots, wherein the first end of each arm extends through a respective one of the apertures, wherein each arm is adapted to extend out of the aperture to an extended position and retract into the respective one of the slots to a retracted position when the arm slides within the respective slot, and wherein a stop at the second end of each arm establishes a maximum extension length and prevents the arm from fully exiting the slot through the respective aperture. The cap is attached to the first end of each arm, wherein the cap is adapted to assist a user in holding the protective case, wherein the cap is adjacent the back surface of the protective case when the arms are in the retracted positions, and wherein the cap and the arms extend away from the back surface of the protective case in a substantially perpendicular direction when the cap is pulled outward and the arms transition to the extended positions.

In another exemplary embodiment, a grip system is configured for assisting holding of an electronic device. The grip system comprises a protective case and a grip apparatus. The protective case comprises a protective shell for receiving the electronic device and covering at least a portion of a housing of the electronic device. The protective case has a back surface which has a recess. The grip apparatus is removably attachable to the back surface of the protective case. The grip apparatus comprises a base, two flexible strips or straps, and a cap. The base is configured to be removably inserted into the recess in the back surface of the protective case for removably attaching the grip apparatus to the protective case. The two flexible strips are each formed from a bendable material, wherein each flexible strip includes a first end and a second end, and wherein the first end of each flexible strip is attached to the base. The cap is configured to assist a user in holding the protective case, wherein the cap is proximate a top surface of the base when in a stowed position, and wherein the cap is extendable away from the top surface of the base away from the protective case when the cap is pulled outward to extend the cap to an extended position. Each flexible strip is configured or adapted to slide, at least partially, within a slot in the cap. Each flexible strip slides into the slot when the grip apparatus is transitioned to the stowed position and slides outward from the slot when the grip apparatus is transitioned to the extended position. A stop proximate the second end of each flexible strip establishes a maximum extension length and prevents each flexible strip from fully exiting the slot of the cap.

In another exemplary embodiment, a grip apparatus for facilitating holding of an electronic device includes a base, an extension arm, and a cap. The base has a bottom surface and a top surface, wherein the bottom surface is configured for attachment to the electronic device or to a protective case for the electronic device, wherein the base includes a linear channel between the top surface and the bottom surface, wherein the base further includes an aperture in the top surface, wherein the aperture extends from the top surface of the base into the linear channel. The extension arm is formed from a semi-rigid bendable material, wherein the extension arm includes first and second ends and is configured to slide, at least partially, within the linear channel, wherein a center portion of the extension arm is accessible through the aperture in the top surface of the base, wherein the extension arm is configured to extend out of the aperture to an extended position and retract into the linear channel to a retracted position when the extension arm slides within the linear channel, and wherein each end of the extension arm includes a respective stop which establishes a maximum extension length and prevents the extension arm from fully exiting the linear channel when at the extended position. The cap is attached to the center portion of the extension arm, wherein the cap is configured to rest against one or more fingers of a user holding the electronic device, wherein the cap is proximate the top surface of the base when the extension arms are in the retracted positions, and wherein the cap and the extension arm extend away from the top surface of the base in a substantially perpendicular direction when the cap is pulled outward and the center portion of the extension arm is pulled out of the aperture toward the extended position.

In another exemplary embodiment, a grip device for facilitating holding of an electronic device comprises a base, and arm, and a cap. The base has a bottom surface and a top surface, wherein the bottom surface is adapted for attachment to the electronic device or for attachment to a protective case for the electronic device, wherein the base includes a slot and an aperture at the top surface, wherein the aperture extends from the top surface of the base into the slot. The arm is formed from a bendable material, wherein the arm includes first and second ends and is adapted to slide, at least partially, within the slot, wherein a center portion of the arm is extendable through the aperture in the top surface of the base, wherein the arm is adapted to extend out of the aperture to an extended position and retract into the slot to a retracted position when the arm slides within the slot, and wherein stops at the first and second ends of the arm establishes a maximum extension length and prevents the arm from fully exiting the slot. The cap is attached to the center portion of the arm, wherein the cap is adapted to assist a user in holding the electronic device, wherein the cap is proximate the top surface of the base when the arm is in the retracted position, and wherein the cap and the arm extend away from the top surface of the base in a substantially perpendicular direction when the cap is pulled outward and the arm transitions to the extended positions.

In another exemplary embodiment, a protective case for an electronic device includes a protective shell, an arm, and a cap. The protective shell is configured for receiving the electronic device and covering at least a portion of a housing of the electronic device, wherein the protective shell includes an internal slot and an aperture at a back surface of the protective shell, wherein the aperture extends from the back surface into the slot near a center of the slot. The arm is formed from a bendable material, wherein the arm is adapted to slide, at least partially, within the slot, wherein a center portion of the arm may be pulled out of the slot through the aperture, wherein the arm is adapted to extend out of the aperture to an extended position and retract into the slot to a retracted position when the arm slides in the slot, and wherein stop at the ends of the arm establishes a maximum extension length and prevents the arm from fully exiting the slot through the aperture. The cap is attached to the center portion of the arm, wherein the cap is adapted to assist a user in holding the protective case, wherein the cap is adjacent the back surface of the protective case when the arm is in the retracted position, and wherein the cap and the arm extends away from the back surface of the protective case in a substantially perpendicular direction when the cap is pulled outward and the arm transitions to the extended position.

In another exemplary embodiment, a grip device for facilitating holding of an electronic device includes a base, two bendable straps, and a cap. The base is adapted for attachment to the electronic device or for attachment to a protective case for the electronic device. The two bendable straps are each formed from a bendable material, wherein each bendable strap includes a first end and a second end, wherein the first end of each bendable strap is attached to the base. The cap is adapted to assist a user in holding the electronic device or the protective case for the electronic device, wherein the cap is proximate a top surface of the base when in a stowed position, wherein the cap is extendable away from the top surface of the base in a substantially perpendicular direction when the cap is pulled outward to extend the cap to an extended position, wherein each bendable strap is adapted to slide, at least partially, within a respective slot of the cap, wherein the second end of each bendable strap slides into the respective slot when the grip device is transitioned to the stowed position and slides out of the respective slot when the grip device is transitioned to the extended position, and wherein a stop at the second end of each bendable strap establishes a maximum extension length and prevents the bendable strap from fully exiting the respective slot of the cap.

In another exemplary embodiment, a grip apparatus for facilitating holding of an electronic device includes or comprises a base, two straps, and a cap. The base is configured for attachment to the electronic device or for attachment to a protective case for the electronic device. The two straps are each formed from a bendable material, wherein each strap includes a first end and a second end, wherein the first end of each strap is attached to the base. The cap is configured to assist a user in holding the electronic device and/or the protective case for the electronic device, wherein the cap is proximate a top surface of the base when in a stowed position, wherein the cap is extendable away from the top surface of the base away from the electronic device and/or the protective case when the cap is pulled outward to extend the cap to an extended position, wherein each bendable strap is configured to slide, at least partially, within a slot in the cap, wherein the second end of each bendable strap slides into the slot when the grip apparatus is transitioned to the stowed position and slides out of the slot when the grip apparatus is transitioned to the extended position, and wherein a stop at the second end of each strap establishes a maximum extension length and prevents the strap from fully exiting the slot of the cap.

Other variations are possible.

DETAILED DESCRIPTION

As people carry electronic devices with them more frequently, they have become more interested in using them for a wider variety of tasks and in a wider variety of situations. Electronic devices, particularly portable electronic devices, are being used now more than ever and the longer devices are held by the user the greater the chance that they are dropped or otherwise damaged. In addition, people are using their electronic devices in a greater variety of situations. Electronic devices are also increasingly used with protective cases and/or covers that protect the electronic devices from a variety or forces or elements such as dropping, impact, and scratching. In some cases, these challenges are coupled with an increasing need for holders or stands that hold the device in a particular preferred configuration or location when the user wants the device to be visible and/or in a particular orientation but may not necessarily be holding it.

While most of the electronic device cases and/or covers discussed herein are described as "protective" cases, the apparatuses and techniques disclosed herein do not necessarily require that the case is protective and could apply to any type of electronic device case, cover, sleeve, sheath, attachment panel, etc. In other examples, the case may be water-resistant or water proof for protecting the electronic device from water or other liquids. In yet other examples, the case may have other characteristics, such as but not limited to, water resistance, chemical resistance, and/or antimicrobial characteristics. In other examples, any of the grips, grip devices, or apparatuses disclosed herein may be used directly with an electronic device and need not necessarily be used with a protective case.

Figure 1:
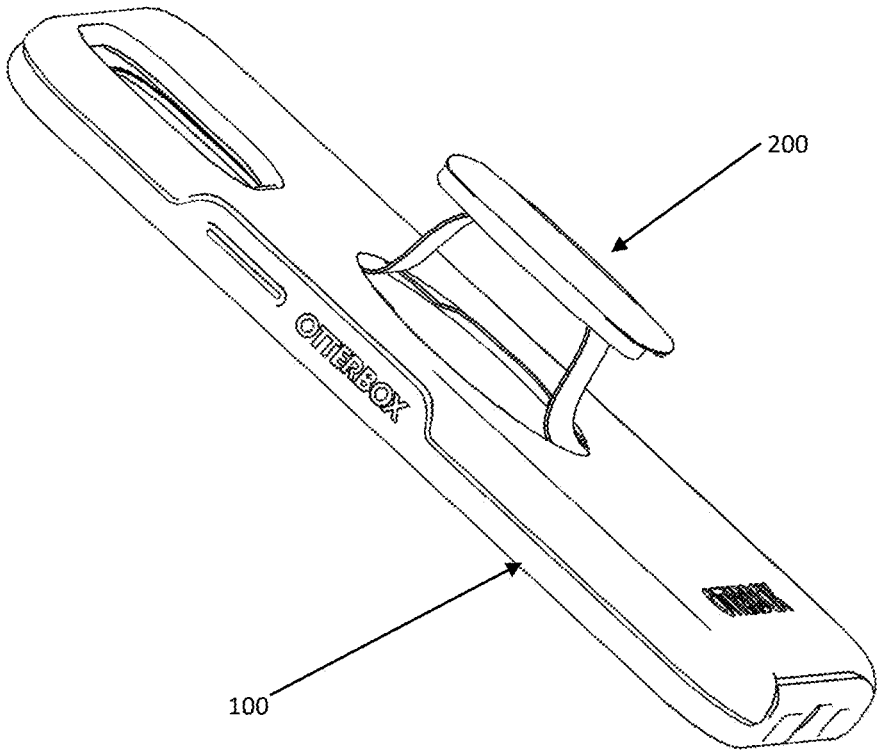
FIG. 1 illustrates a protective case and a grip for use with an electronic device.

FIG. 1 illustrates a protective case 100 for an electronic device. Protective case 100 may also be called a protective cover. Protective case 100 is configured with a retractable device grip 200. Variations of device grips will be disclosed herein. Different case designs accommodating different grips, holders, and/or stands may involve changing shapes, sizes, dimensions, geometries, quantities, and/or positions of case features described herein to accommodate other grips, holders, or stands.

Figure 2:
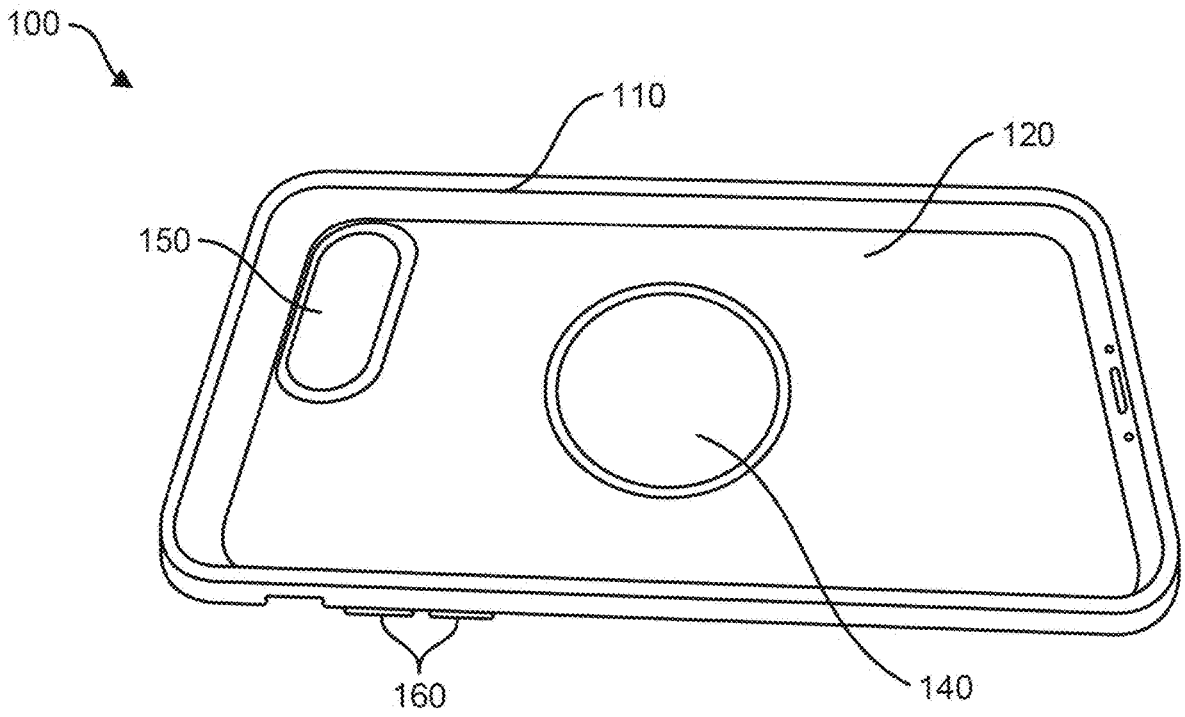
FIG. 2 illustrates a front view of a protective case.

FIG. 2 illustrates a front view of protective case 100 for use with an electronic device, such as a smartphone. Protective case 100 includes a body 110 and an inner surface 120. Inner surface 120 provides the primary surface(s) for receiving and holding the electronic device in protective case 100. Inner surface 120 may contact the electronic device on any one or more of a back surface, on one or more side surfaces, and/or on a portion of a front surface of the electronic device. In some situations, inner surface 120 may also be referred to as or may include a cushion layer, cushioning member, or cushion liner. Inner surface 120 can be made of any suitable material such as an elastomer. The elastomer may be, but is not limited to, a thermoplastic elastomer or silicone rubber. Inner surface 120 may comprise a material that is softer than a material of body 110 for purposes of cushioning, protecting, and/or retaining the electronic device.

Inner surface 120 may be configured to cushion an installed electronic device from external forces, impacts, sudden acceleration, sudden deceleration, and/or other forces experienced at outer surfaces of protective case 100. Further, the compliant nature of inner surface 120 may allow it to flexibly hold the electronic device to reduce movement, shifting, or rattling of the electronic device within protective case 100. Inner surface 120 may contain cavities, coring, reliefs, ribs, channels, recesses, a grid pattern, protrusions, and/or other similar features for holding the electronic device in place, for protecting the electronic device, and/or for potentially reducing the surface area of contact between inner surface 120 and the installed electronic device.

In some embodiments, inner surface 120 may not cover the entire internal surface of the protective case. In one specific example, inner surface 120 may extend around an internal perimeter of the protective case and may not span the entire back of the protective case or the installed electronic device.

Protective case 100 also includes a front opening which permits or allows access to at least some portion of the installed electronic device. In one example, the front opening permits access to an interactive interface of the electronic device such as a touchscreen, a touch screen interface, a resistive touchscreen, a display, and/or a capacitive touchscreen. The front opening may contain a lip or edge that removably retains the electronic device in the protective case such that it does not easily or readily come out of the protective case but can still be intentionally removed by a user when desired. The front opening may also include a lip, ledge, protrusion, raised edge, rim, elevated rim, elevated protective rim, or other raised feature around at least a portion of the front opening to reduce the chances of a front surface of the installed electronic device from coming into contact with another object or surface, particularly when protective case 100 is laid face down on a flat surface, such as on a table.

Body 110 of protective case 100 may also be referred to as a structural layer, a frame, a rigid layer, a bottom shell, a shell member, an outer shell, and/or a shell of protective case 100. Body 110 extends around some or all of the outer surface of inner surface 120. Body 110 will typically be manufactured from a material that is harder, more rigid, stiffer, more puncture resistant, more crush resistant, more chemical resistant, and/or more abrasion resistant than the material of inner surface 120, if any. The material of body 110 can be any suitable material such as a thermoplastic polymer or a synthetic polymer. The material can include polycarbonate, nylon, or glass filled nylon. Alternately, any other material, or combination of materials, which provide rigidity to protective enclosure 100 can be used. Body 110 can be formed using any suitable process, such as an injection molding process. The back or sides of body 110 may also include stylistic patterns, images, graphics, and/or one or more color combinations.

Protective case 100 also includes camera aperture 150 in a back surface of protective case 100. Camera aperture 150, which may also be called an opening, provides optical access and/or an optical path to/from a camera and/or a flash of an installed electronic device. In other words, camera aperture 150 permits use of the camera and/or flash even though the electronic device is installed in protective case 100 and much of the back of the electronic device is covered by protective case 100. Camera aperture 150 may be covered with a clear, mostly clear, transparent, or mostly transparent membrane, lens, or film that protects the camera and/or the flash but also still permits optical access and/or an optical path to/from the camera and/or flash. In some examples, the membrane or film may serve a lensing function and/or provide an optical effect, such as magnification.

Protective case 100 provides protection for an installed electronic device against external forces by reducing or eliminating transfer of those forces to the installed electronic device, as well as providing a relatively soft contact surface for the installed electronic device. The relatively soft contact surface can resist scratching, scraping, marring, and/or rub marks. While providing protection, protective case 100 enables a user to still use the electronic device while it is in protective case 100.

In one embodiment, one of inner surface 120 and body 110 may be comolded (or co-molded) onto the other, comolded with the other, or overmolded onto the other. In another embodiment, they may be molded as separate pieces and adhered together after the molding process. In yet other embodiments, inner surface 120 and body 110 may not be formed, molded, or adhered together but may fit together as an assembly. Inner surface 120 and body 110 may have approximately the same thickness throughout protective enclosure 100 and in other embodiments can vary in thickness. The thickness can vary depending on the manufacturing process and/or the design of protective enclosure 100. In yet other embodiments, inner surface may not be formed from a different material than body 110 and inner surface 120 may simply be the inner surface of the member that makes up body 110.

When inner surface 120 and body 110 are formed, adhered, or fitted together, protective case or enclosure 100 may provide a one-piece construction that functions like, and provides benefits similar to, a more costly and possibly more complicated two-piece or three-piece assembly. However, it should be understood that the protective case features described herein are not to be limited to a protective case with an inner liner and an outer shell. It should be understood that the improvements disclosed herein may be implemented in a case with a single layer (e.g., a hard rigid layer or a soft flexible layer), a case made of a single material (e.g., a polycarbonate, a silicone, etc.), a case made of a single component, a case with more than two layers, a case made of more than two materials, and/or a case made of more than two components. For example, the case improvements disclosed herein could be implemented into a clam shell case with two or more pieces, a sliding case with two or more pieces, a hinged case with two or more pieces, etc. In other examples, protective case 100 may be a case that is assembled from a greater number of components or members. For example, protective case 100 may be assembled from two members, three members, four members, or more. The improvements disclosed herein are not intended to be limited to any particular case or protective case design.

Protective case 100 also includes one or more button pads 160 on one or more sides of protective case 100. In some cases, button pads 160 may be formed in or from the material that makes up inner surface 120. Button pads 160 correspond to respective buttons or control features of an installed electronic device. Button pads 160 enable actuation or operation of the respective buttons or control features of the installed electronic device from outside of protective case 100 without necessarily having direct access to the buttons or control features. Body 110 and/or inner surface 120 may also include another aperture, hole, or opening for directly accessing a button, switch, port, or control feature of the installed electronic device. Button pads and apertures may have many other shapes or configurations. A protective case may have more or fewer button pads or apertures than illustrated, or no button pads or apertures at all.

Protective case 100 also includes grip aperture 140 in the back surface of protective case 100. Grip aperture 140 extends from inside of protective case 100 through inner surface 120 and body 110 to provide an aperture or hole that extends all the way through to the back of the case. As discussed with respect to other figures herein, grip aperture 140 facilitates operation and use of a device grip, with a protective case, such as protective case 100. The size, shape, quantity, or position, of grip aperture 140 may vary. In some examples, there may be no grip aperture and any of the disclosed grips may be attached directly to an outer surface of protective case 100 and/or directly to a back surface or housing of an electronic device.

Any of the device grips disclosed herein may be implemented as a standalone device or apparatus which is attachable, either permanently or removably, to an electronic device and/or to a case for an electronic device. Alternatively, any of the device grips or apparatuses disclosed herein may be integrated into the housing of an electronic device and/or integrated into a case for an electronic device, either permanently or removably.

The grips and holders disclosed herein are configured or adapted for assisting a user in holding an electronic device and reducing the chances of the user dropping the device. In many examples, the grip is extendable for use and retractable or stowable when not in use. In the extended or use position, the user may extend one or more fingers through or around the grip to assist in holding the device. The grip may also act as a stand for one or more viewing orientations for the electronic device when the electronic device is sitting on a surface such as a desk. The retracted or stowed position is preferred when the grip is not in use in order to reduce any negative effects of the grip such as getting caught on the edge of a pocket, a purse, or a bag. It is also preferred to reduce the thickness of the grip as much as possible in the retracted or stowed position to better accommodate other functions such as wireless charging, attachment of or to other accessories, and storage.

Figure 3:
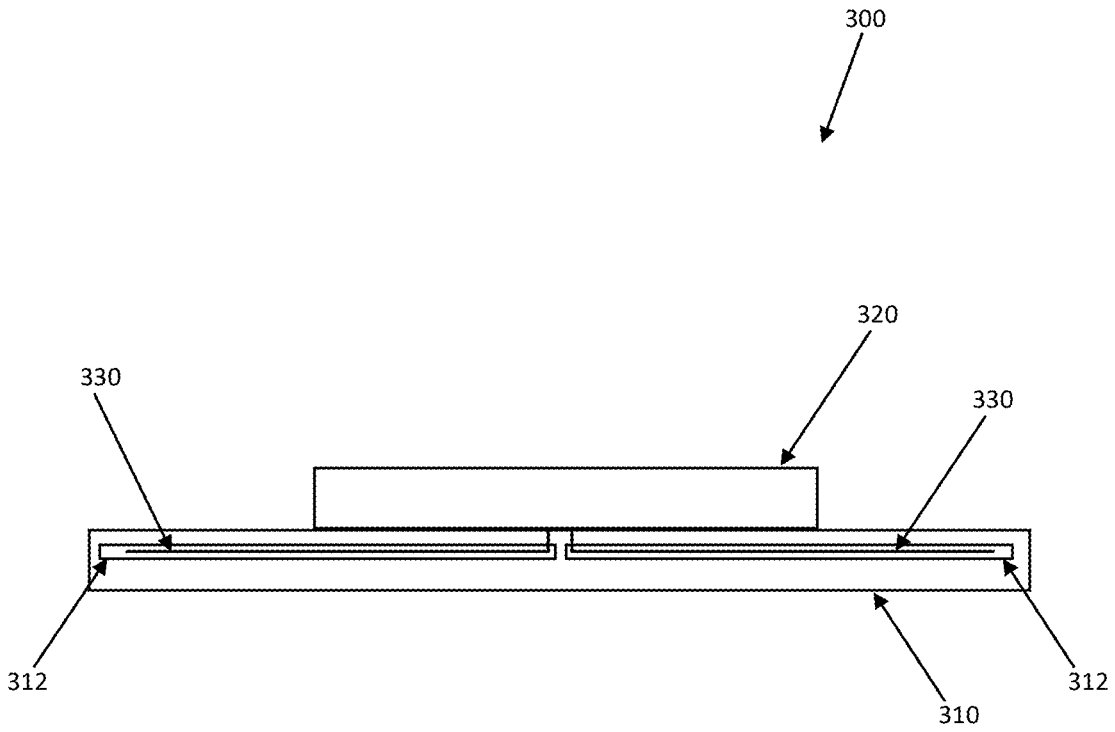
FIG. 3 illustrates a side sectional view of a device grip.

FIG. 3 illustrates a side sectional view of a grip 300 for use with an electronic device and/or with a case for an electronic device. Grip 300 includes a base 310 and a cap 320. While illustrated in FIG. 3 as a standalone apparatus, grip 300 may be integrated into an electronic device or into a case for an electronic device and base 310 may be part of the electronic device, the housing for the electronic device, or the case for the electronic device. Cap 320 is illustrated in the stowed or retracted position. Cap 320 may also be referred to as a top, a top portion, a grip portion, or a button. As illustrated in subsequent figures, cap 320 may be extended into the extended or use position.

The elements of grip 300 are illustrated in FIG. 3 with basic shapes for purposes of explanation of the operation of grip 300. However, it should be understood that any of the elements of grip 300 may have different shapes or sizes while retaining similar functionality. Further, any of the elements disclosed herein may be made from a single component or may be made up of multiple components. Any of the grips disclosed herein may also be referred to as a device grip, a grip apparatus, a gripping apparatus, a holder, a device holder, a device holding apparatus, a case holder, a case handle, a stand, and/or a device stand. Any of the grips or caps disclosed herein may be designed to pivot and/or rotate to permit movement of the device and/or protective case while the grip is being held. Any of the caps disclosed herein may be decorated with any variety of colors, pictures, or graphics. Any of the caps disclosed herein may be removable and replaceable with a different cap for purposes of changing the colors, pictures, or graphics without replacing the entire grip or case.

Grip 300 also includes two bendable strips 330 which are attached to cap 320. Bendable strips 330 may be formed from any relatively thin flexible, bendable, and/or resilient material that is substantially flat and may return to its substantially flat state after being bent. Bendable strips 330 may be formed from a plastic film, from a plastic strip, from a thin metallic strip, or from another material that is bendable, semi-rigid, rigid, and/or returns to its original shape. In some examples, bendable strips 330 may have some cross-sectional curvature, similar to a metal measuring tape, which further causes them to tend to return to a straight or flat position. Bendable strips 330 may also be referred to as strips, straps, bendable straps, arms, bendable arms, or extension arms. In FIG. 3, bendable strips 330 appear as lines because they are being viewed from the side. Bendable strips 330 are each positioned in a slot 312 of base 310 and extend through an opening or aperture of base 310 to be attached to cap 320. Slots 312 may also be referred to as a cavity or a channel. In some examples, slots 312 may not be fully enclosed and may be formed as a channel in a surface with extensions or tabs which extend over the channel only partially to retain bendable strips 330 in the channel.

Figure 4:
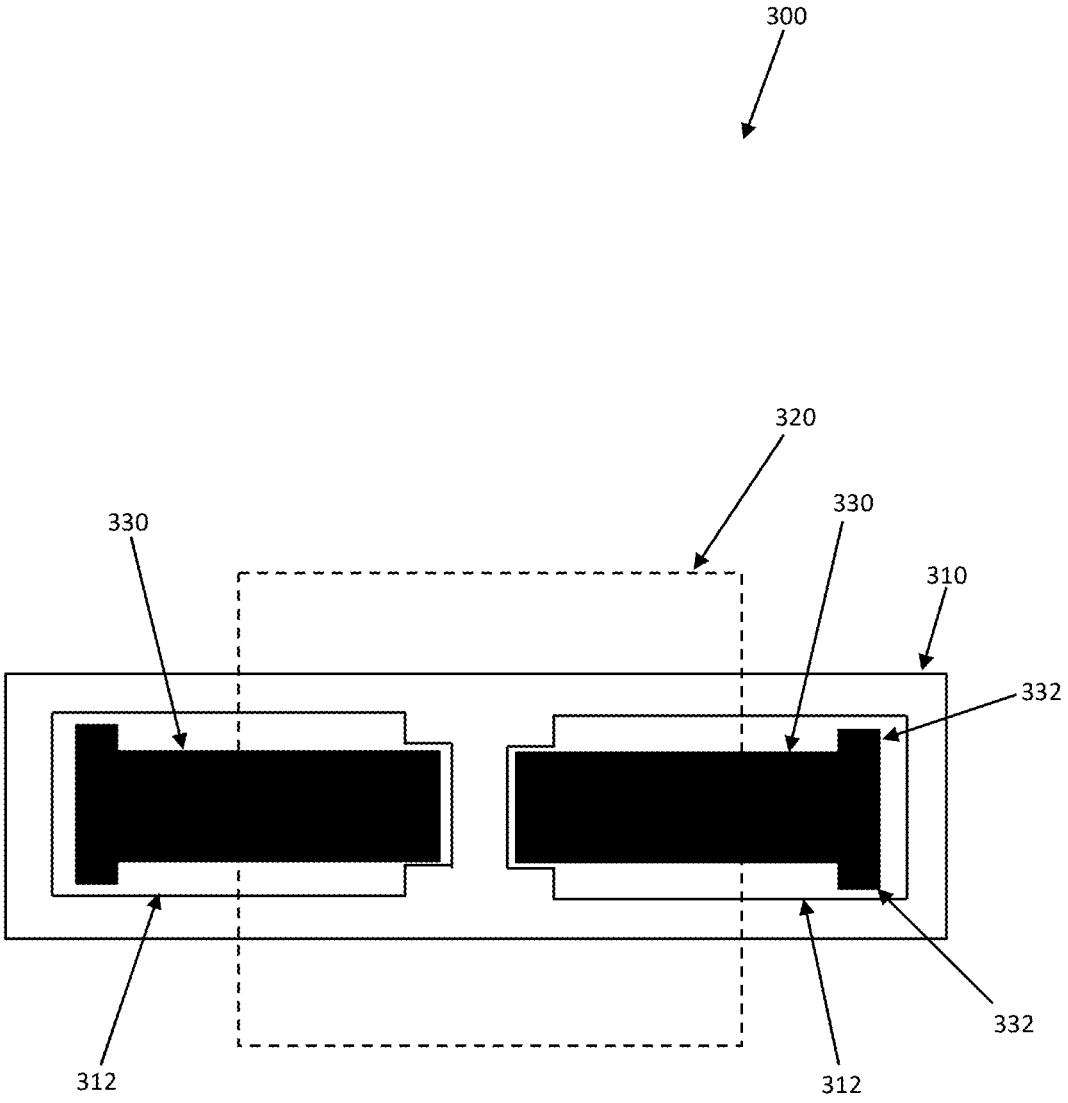
FIG. 4 illustrates a top sectional view of the device grip of FIG. 3.

FIG. 4 illustrates a top sectional view of grip 300 of FIG. 3. The section view of FIG. 4 cuts through base 310. Cap 320 is illustrated in dashed lines for reference only. FIG. 4 illustrates bendable strips 330 in slots 312. The ends of bendable strips 330 extend up (out of the page) through openings or apertures to attach to cap 320. Each of bendable strips 330 includes one or more stop features 332 which corresponds to a shape of the end of the corresponding slot 312. As explained further in subsequent figures, stop features 332 prevent bendable strips 330 from sliding or extending all the way out of or exiting slots 312.

Figure 5:
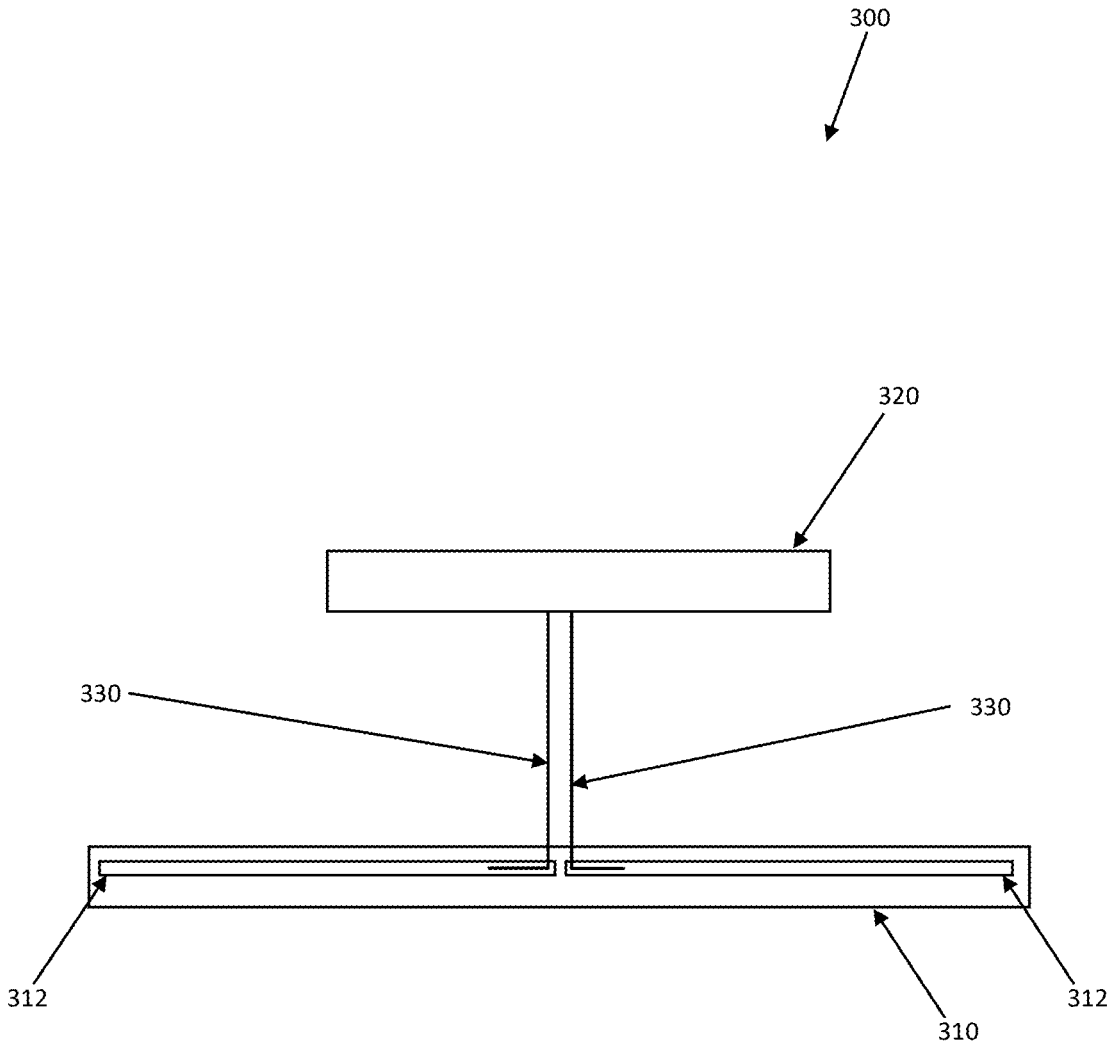
FIG. 5 illustrates a side sectional view of the device grip of FIG. 3 in the extended position.

FIG. 5 illustrates a side sectional view of grip 300, similar to FIG. 3, but in the extended or use position. Cap 320 has been pulled or extended upward such that a user can place one or more fingers between cap 320 and base 310. Alternately, cap 320 may be used as a stand. When pulled up, bendable strips 330 are partially pulled out of slots 312. They can be pulled until stop features 332 reach the corresponding shoulder or stop feature of slots 312 (see FIG. 4) and prevent the bendable strips 330 from extending or exiting slots 312 any further. Since bendable strips 330 are semi-rigid and are extending from opposite directions they tend to press against each other and hold cap 320 up in the extended position. While the grip illustrated in FIG. 1 has some features that are different than grip 300, FIG. 1 generally illustrates the use position of any of the grips disclosed herein relative to a protective case.

In the example of FIG. 5, bendable strips 330 are viewed from their edges such that they appear very thin. When viewed from another direction, such as from the left of the page or the right of the page, each bendable strip will have a more substantial width that is not visible in FIG. 5. The width of any of the bendable strips, straps, or arms disclosed herein may also be reduced or variable, such as having an hourglass shape, to better accommodate a user's fingers in more than one direction. In other words, the width of any of the bendable strips disclosed herein may not be uniform and may include contours where a user's fingers are expected such that the user does not have to spread his fingers as far apart to hold the grip from a variety of directions or orientations.

Figure 6:
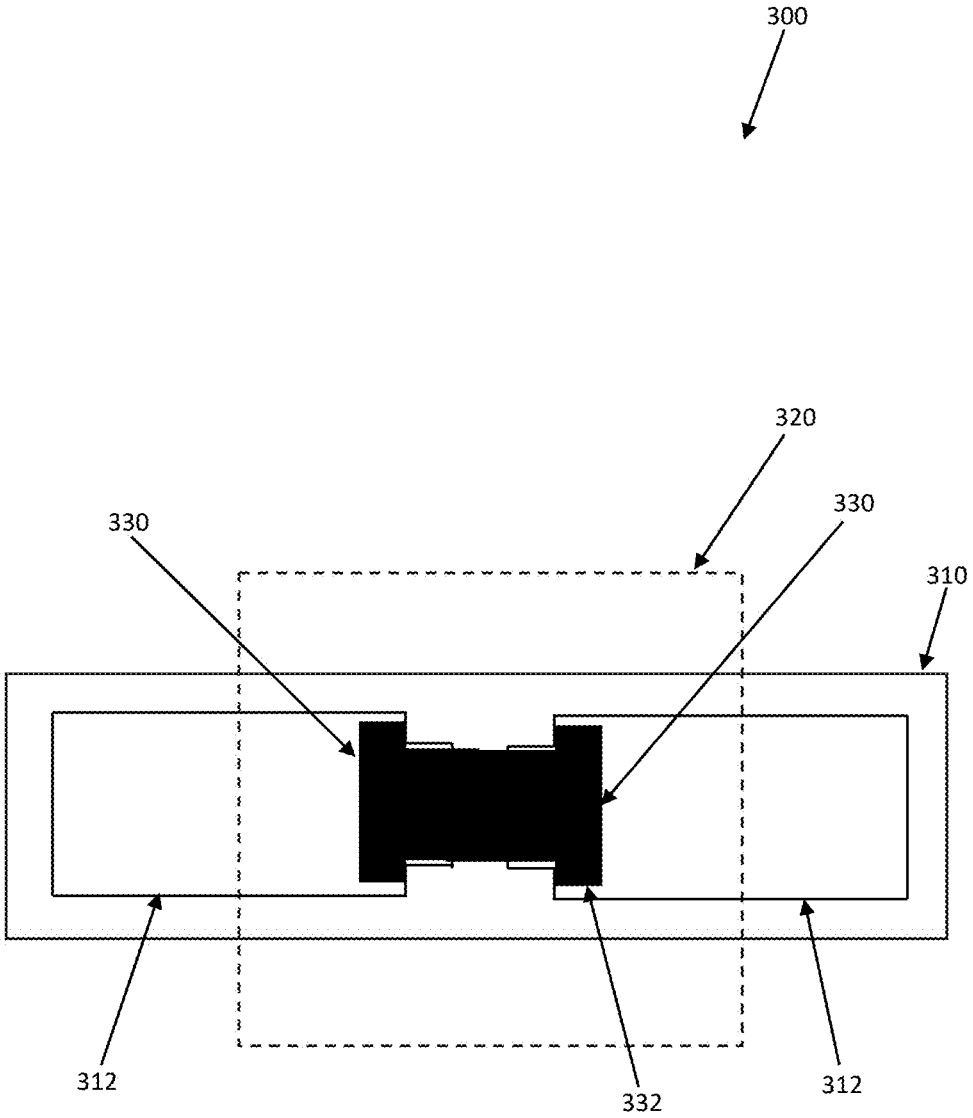
FIG. 6 illustrates a top sectional view of the device grip of FIG. 5.

FIG. 6 illustrates a top sectional view of grip 300 of FIG. 5 in the extended position. The section view of FIG. 6 cuts through base 310. Cap 320 is illustrated in dashed lines for reference only. FIG. 6 illustrates bendable strips 330 extended out of slots 312. The extended ends of bendable strips 330 extend up (out of the page) to attach to cap 320, which is extended to or toward the use position. The stop features 332 are at or near the stops of slots 312 preventing bendable strips 330 from sliding or extending further out of slots 312. In this way, cap 320 remains attached to base 310 and can only be extended out a specified distance. After use, cap 320 can be pressed or pushed down and returned to the retracted or stowed position illustrated in FIGS. 3 and 4.

Figure 7:
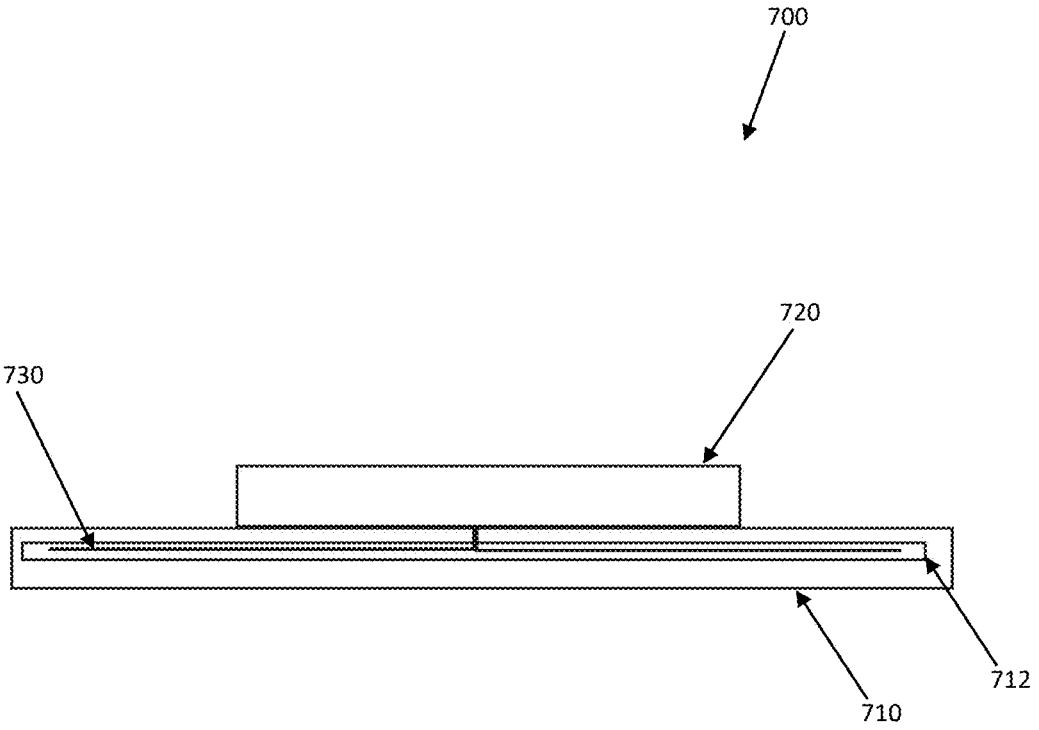
FIG. 7 illustrates a side sectional view of a device grip.

FIG. 7 illustrates a side sectional view of a grip 700 for use with an electronic device and/or with a case for an electronic device. Grip 700 may include any of the features, functions, elements, or characteristics of grip 300. Grip 700 includes a base 710 and a cap 720. Base 710 may include any of the features, functions, elements, or characteristics of base 310. Cap 720 may include any of the features, functions, elements, or characteristics of cap 320. While illustrated in FIG. 7 as a standalone apparatus, grip 700 may be integrated into an electronic device or a case for an electronic device and base 710 may be part of the electronic device, the housing for the electronic device, or the case for the electronic device. Cap 720 is illustrated in the stowed or retracted position. Cap 720 may also be referred to as a top, a top portion, or a button. As illustrated in subsequent figures, cap 720 may be extended into the extended or use position. The elements of grip 700 are illustrated in FIG. 7 with basic shapes for purposes of explanation of the operation of grip 700. However, it should be understood that any of the elements of grip 700 may have different shapes or sizes while retaining same or similar functionality. Further, any of the elements disclosed herein may be made from a single component or may be made up of multiple components.

Grip 700 also includes a bendable strip 730 which is attached to cap 720. Bendable strip 730 may include any of the features, functions, elements, or characteristics of bendable strips 330. Bendable strip 730 may be formed from any relatively thin flexible and/or bendable material that is substantially flat and tends to return to its substantially flat state after being bent. Bendable strip 730 may be formed from a plastic film, a plastic strip, from a thin metallic strip, or from another material. In some examples, bendable strip 730 may have some cross-sectional curvature, similar to a metal measuring tape, which further causes it to have a tendency to return to a straight or flat position. Bendable strip 730 may also be referred to as a strip, strap, arm, bendable strap, bendable arm, or extension arm. In FIG. 7, bendable strip 730 appears as a line because it is being viewed from the thin side. Bendable strip 730 is positioned in a slot 712, which may also be referred to as a channel, of base 710 and extends through one or more openings or apertures of base 710 to be attached to cap 720.

Unlike the configuration of grip 300, bendable strip 730 is a single strip that is attached to cap 720 and extends from cap 720 in both directions into base 710. In one example, bendable strip 730 may be attached to cap 720 near a center point of bendable strip 730. Cap 720 may retain bendable strip 730 using a pin or bar. Slot(s) 712 may also be referred to as a cavity or a channel. In some examples, slot(s) 712 may not be fully enclosed and may be formed as a channel in a surface with extensions or tabs which extend over the channel only partially to retain bendable strip 730 in the channel.

Figure 8:
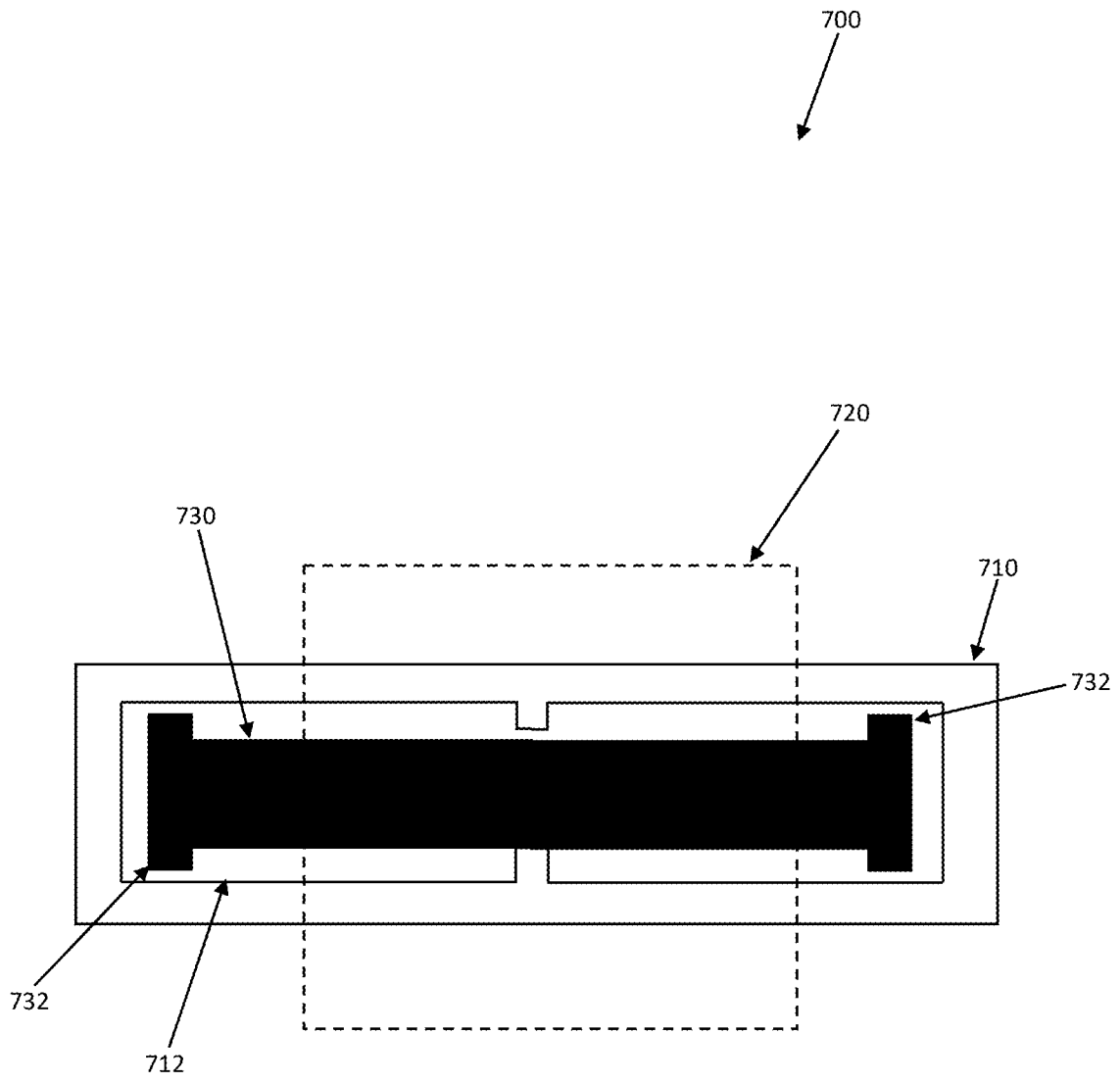
FIG. 8 illustrates a top sectional view of the device grip of FIG. 7.

FIG. 8 illustrates a top sectional view of grip 700 of FIG. 7. The section view cuts through base 710. Cap 720 is illustrated in dashed lines for reference only. FIG. 8 illustrates bendable strip 730 in slot(s) 712. Bendable strip 730 extends up (out of the page) through openings or apertures to attach to cap 720. Bendable strip 730 includes stop features 732 which correspond to a shape of slot 712. As explained further in subsequent figures, stop features 732 prevent each end of bendable strip 730 from sliding or extending all the way out of slot 712.

Figure 9:
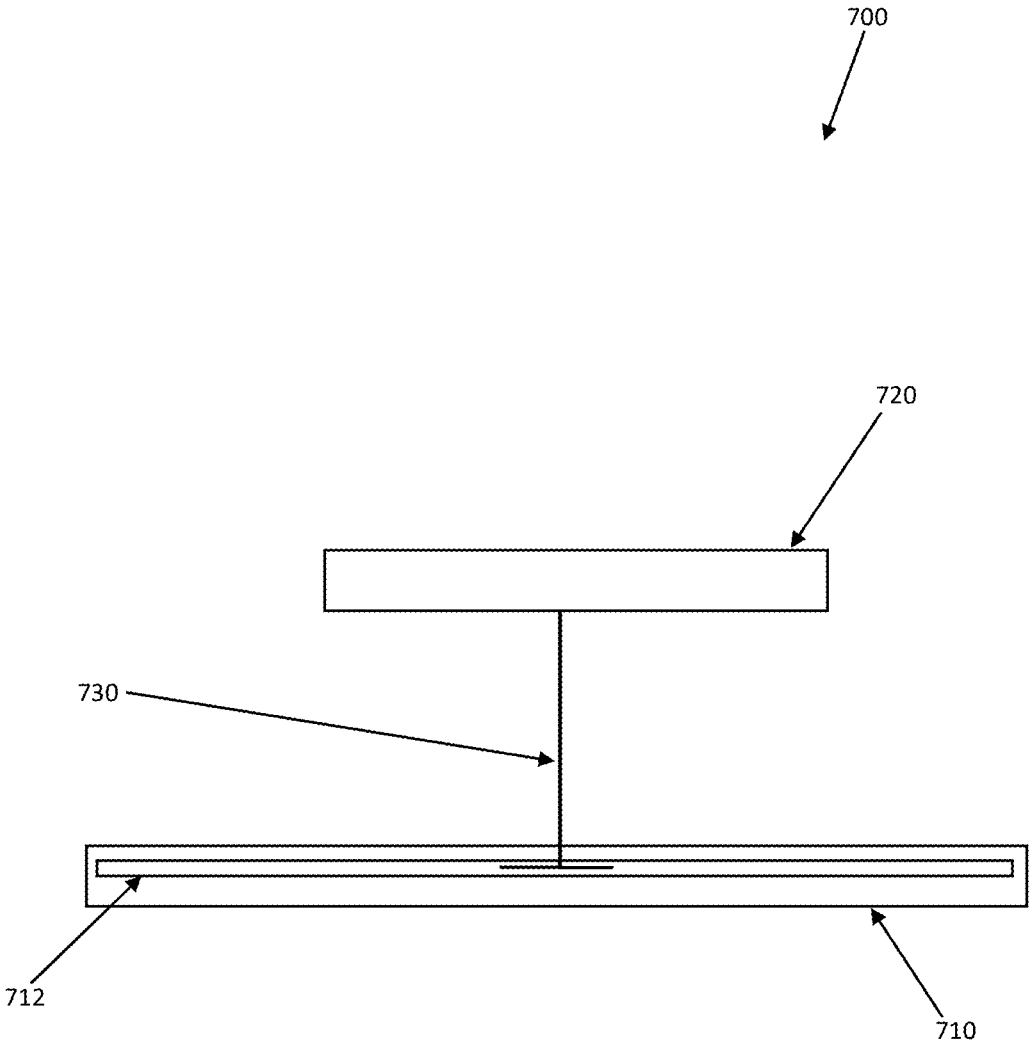
FIG. 9 illustrates a side sectional view of the device grip of FIG. 7 in the extended position.

FIG. 9 illustrates a side sectional view of grip 700, similar to FIG. 7, but in the extended or use position. Cap 720 has been pulled or extended upward such that a user can place one or more fingers between cap 720 and base 710, or to use cap 720 as a stand. When pulled up, bendable strip 730 is partially pulled out of slot 712 from two directions. It is pulled until stop features 732 reach the corresponding shoulders of slot 712 (see FIG. 8) and prevent the bendable strip 730 from extending or exiting slot 712 any further. Bendable strip 730 is flexible enough to permit some side to side movement but rigid enough to hold cap 720 away from base 710 and rigid enough for extended cap 720 to act as a stand when the electronic device is on a table, desk, or other substantially horizontal surface. While the grip illustrated in FIG. 1 has some features that are different than grip 700, FIG. 1 generally illustrates the use position of any of the grips disclosed herein relative to a protective case.

Figure 10:
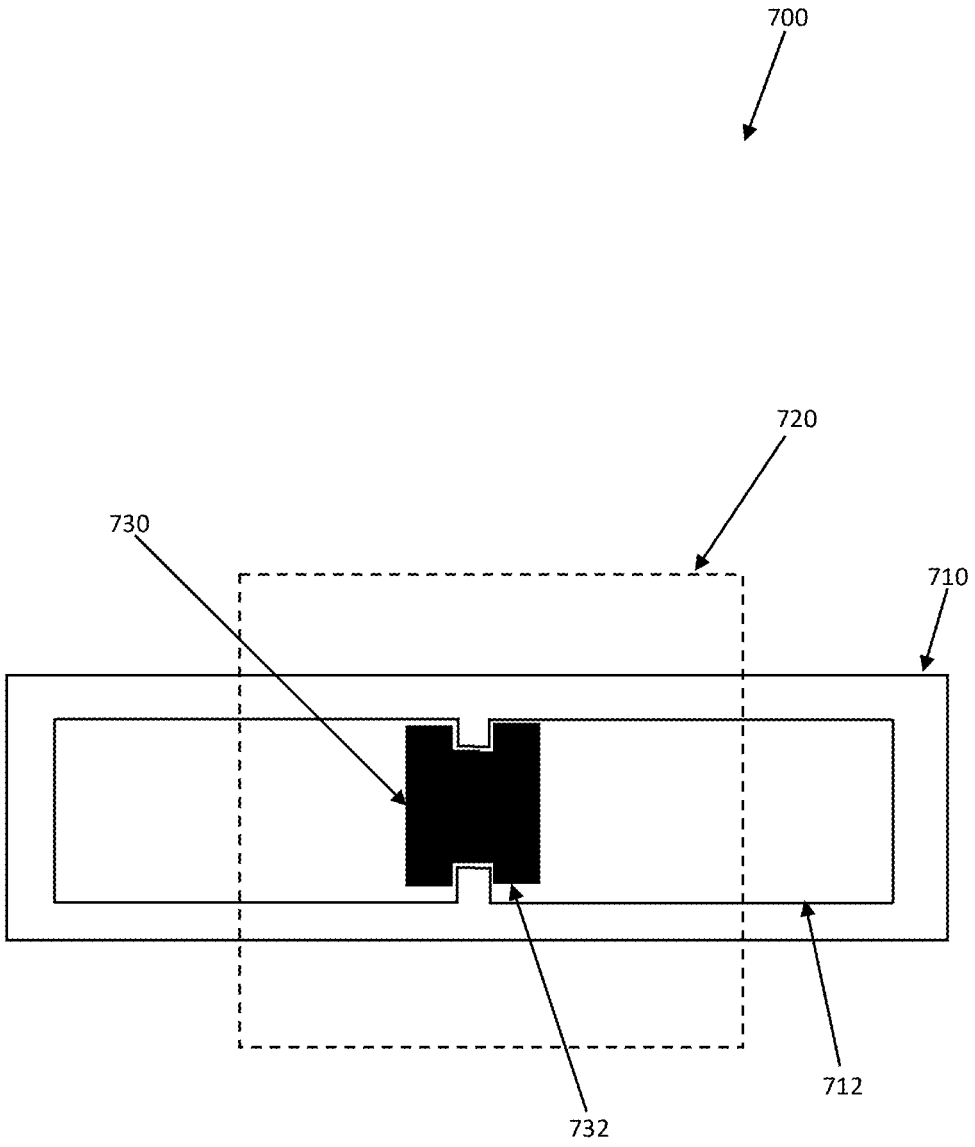
FIG. 10 illustrates a top sectional view of the device grip of FIG. 9.

FIG. 10 illustrates a top sectional view of grip 700 of FIG. 9 in the extended position. The section view cuts through base 710. Cap 720 would exist above the illustrated section, but is illustrated in dashed lines for reference purposes. FIG. 10 illustrates bendable strip 730 extended out of slot(s) 712. Two parallel portions of bendable strip 730 extend up to cap 720. Bendable strip 730 extends up (out of the page) to attach to extended cap 720. The stop features 732 are at or near the stops of slot 712 preventing bendable strips 730 from sliding or extending further out of slot(s) 712. In this way, cap 720 remains attached to base 710 and can only be extended out a specified distance. After use, cap 720 can be pressed or pushed down and returned to the retracted or stowed position illustrated in FIGS. 7 and 8.

Figure 11:
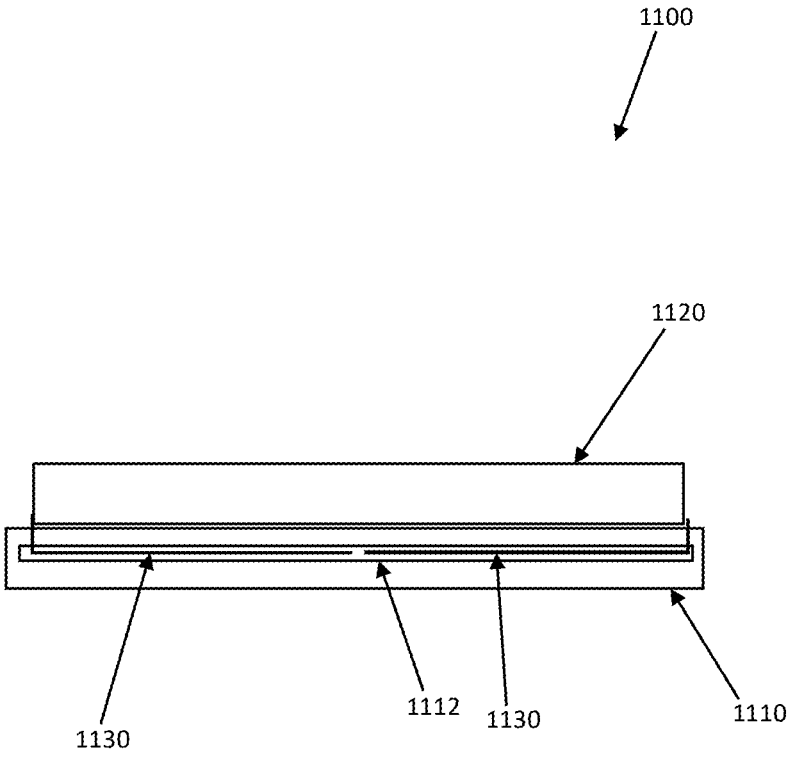
FIG. 11 illustrates a side sectional view of a device grip.

FIG. 11 illustrates a side sectional view of a grip 1100 for use with an electronic device and/or with a case for an electronic device. Grip 1100 may include any of the features, functions, elements, or characteristics of grips 300 or 700. Grip 1100 includes a base 1110 and a cap 1120. Base 1110 may include any of the features, functions, elements, or characteristics of base 310 or 710. Cap 1120 may include any of the features, functions, elements, or characteristics of cap 320 or 720. While illustrated in FIG. 11 as a standalone apparatus, grip 1100 may be integrated into an electronic device or a case for an electronic device. Base 1110 may also be part of the electronic device, the housing for the electronic device, or the case for the electronic device. Cap 1120 is illustrated in the stowed or retracted position. Cap 1120 may also be referred to as a top, a top portion, or a button. As illustrated in subsequent figures, cap 1120 may be extended into the extended or use position. The elements of grip 1100 are illustrated in FIG. 11 with basic shapes for purposes of explanation of the operation of grip 1100. However, it should be understood that any of the elements of grip 1100 may have different shapes or sizes while retaining similar functionality. Further, any of the elements disclosed herein may be made from a single component or may be made up of multiple components.

Grip 1100 also includes bendable strips 1130 which are attached near ends or edges of cap 1120. Bendable strips 1130 may include any of the features, functions, elements, or characteristics of bendable strips 330 or 730. Bendable strip 1130 may be formed from any relatively thin flexible, resilient, and/or bendable material that is substantially flat and tends to return to its substantially flat state after being bent. Bendable strip 1130 may be formed from plastic, a plastic film, from a thin metallic strip, or from another material. In some examples, bendable strips 1130 may have some cross-sectional curvature, similar to a metal measuring tape, which further causes them to tend to return to a straight or flat position. Bendable strips 1130 may also be referred to as a strip, strap, bendable strap, arm, bendable arm, or extension arm. In FIG. 11, bendable strips 1130 appears as lines because they are being viewed from the side. Bendable strips 1130 are positioned in a slot 1112 of base 1110 and extend through openings or apertures of base 1110 to be attached to cap 1120. Unlike grips 300 and 700, bendable strips 1130 extend from opposite or opposing sides or edges of base 1110 and attach to opposing sides or edges of cap 1120. Slot 1112 may also be referred to as a cavity or a channel. In some examples, slot 1112 may not be fully enclosed and may be formed as a channel in a surface with extensions which extend over the channel only partially to retain bendable strips 1130 in the channel.

Figure 12:
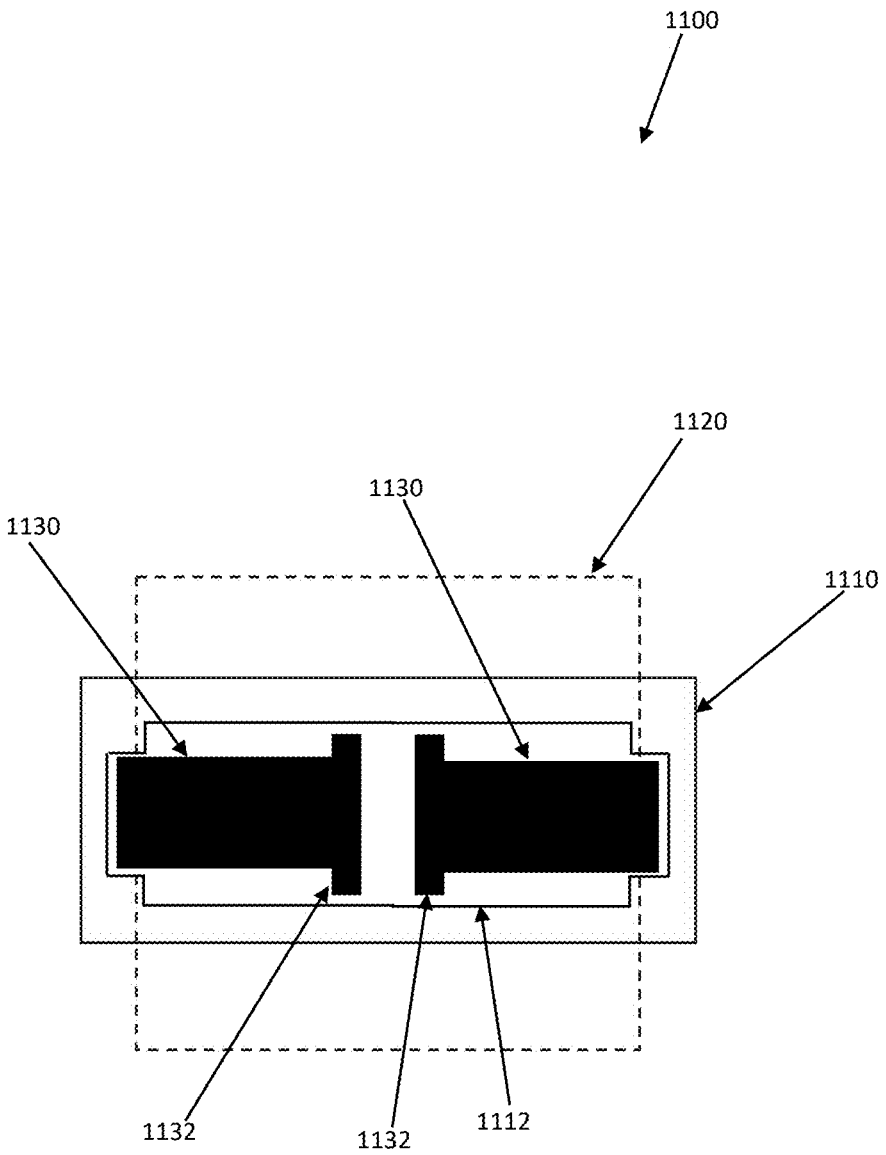
FIG. 12 illustrates a top sectional view of the device grip of FIG. 11.

FIG. 12 illustrates a top sectional view of grip 1100 of FIG. 11. The section view cuts through base 1110. Cap 1120 is illustrated in dashed lines for reference only. FIG. 12 illustrates bendable strips 1130 in slot 1112. Bendable strips 1130 extend up (out of the page) through openings or apertures at opposite ends of base 1110 to attach to cap 1120. Bendable strips 1130 includes stop features 1132 which correspond to a shape at ends of slot 1112. As explained further in subsequent figures, stop features 1132 prevent each end of bendable strips 1130 from sliding or extending all the way out of or exiting slot 1112.

Figure 13:
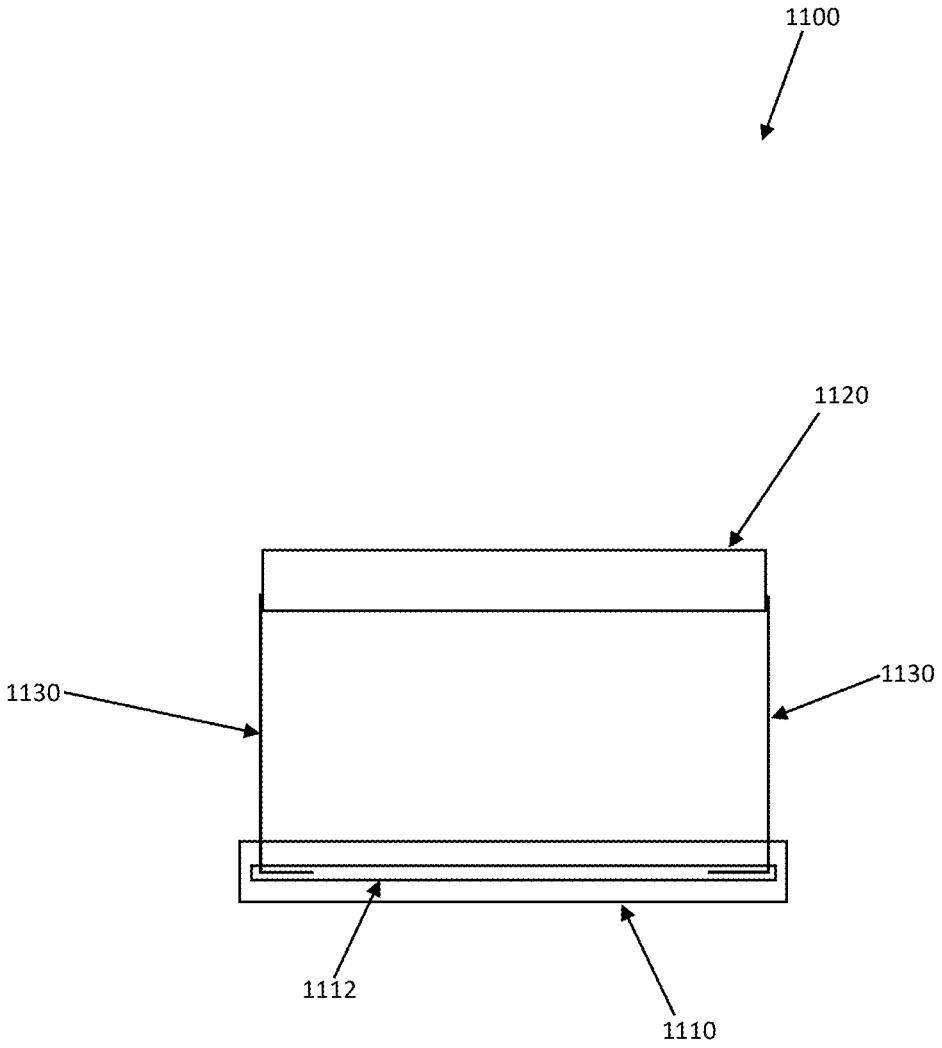
FIG. 13 illustrates a side sectional view of the device grip of FIG. 11 in the extended position.

FIG. 13 illustrates a side sectional view of grip 1100, similar to FIG. 11, but in the extended or use position. Cap 1120 has been pulled or extended upward such that a user can place one or more of fingers between cap 1120 and base 1110 between bendable strips 1130. Cap 1120 may also act as a stand or a holding point for a wall mount, a desk mount, and/or a car mount. When pulled up, bendable strips 1130 are partially pulled out of slot 1112 from two opposite directions. Bendable strips 1130 are pulled until stop features 1132 reach the corresponding shoulders of slot 1112 (see FIG. 12) which prevent the bendable strips 1130 from further extending out of slot 1112 any further and/or exiting slot 1112.

Figure 14:
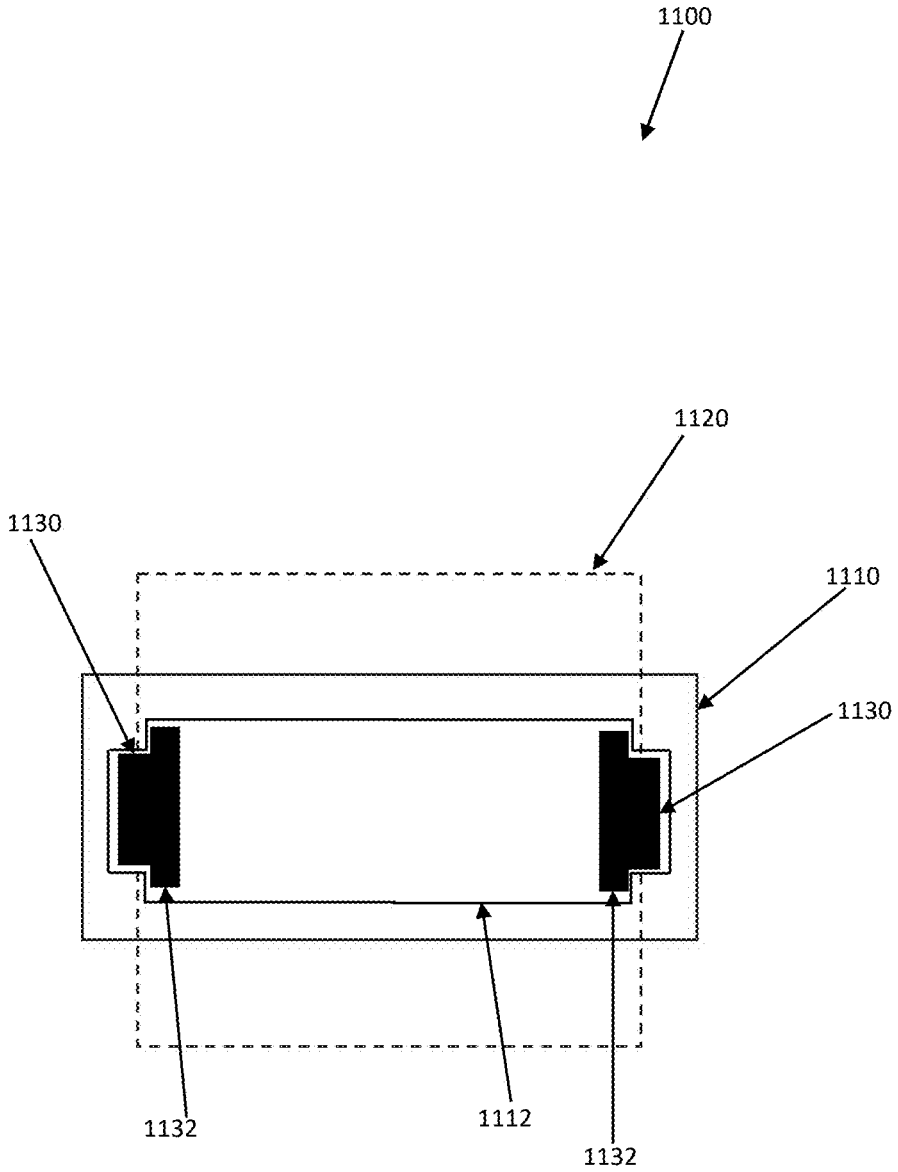
FIG. 14 illustrates a top sectional view of the device grip of FIG. 11.

FIG. 14 illustrates a top sectional view of grip 1100 of FIG. 13 in the extended position. The sectional view cuts through base 1110. Cap 1120 is illustrated in dashed lines for reference only. FIG. 14 illustrates bendable strips 1130 extended out of slot 1112. Each bendable strip 1130 extends up to cap 1120. Bendable strips 1130 extend up (out of the page) to attach to opposing sides or edges of extended cap 1120. The stop features 1132 are at or near the stops of slot 1112 preventing bendable strips 1130 from sliding or extending further out of slot 1112. In this way, cap 1120 remains attached to base 1110 and can only be extended out a specified distance. The fact that bendable strips 1130 extend out from opposite directions and are bent in opposite directions tends to keep cap 1120 centered in an upright position. After use, cap 1120 can be pressed or pushed down and returned to the retracted or stowed position illustrated in FIGS. 11 and 12.

Figure 15:
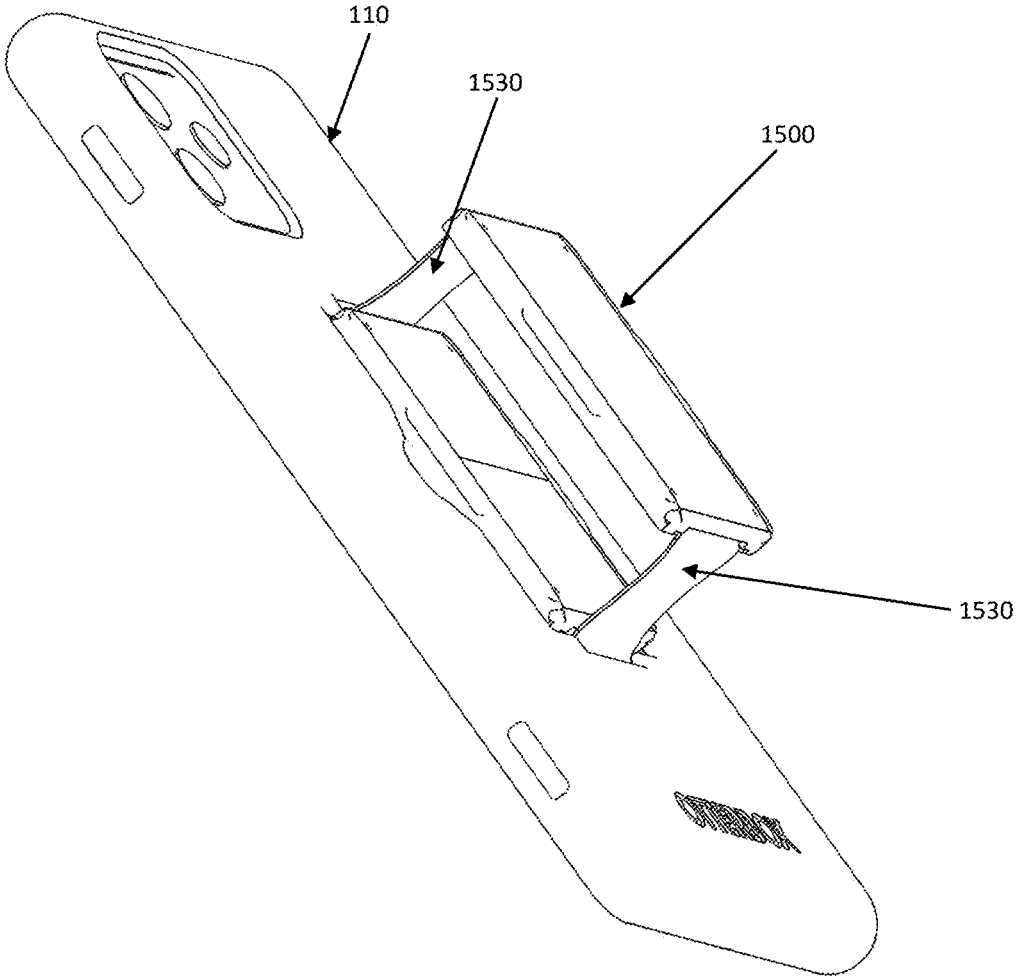
FIG. 15 illustrates the device grip of FIG. 11 attached to a protective case.

FIG. 15 illustrates a grip 1500 attached to the back of a protective case 110. Grip 1500 may include any of the features, functions, elements, or characteristics of grips 300, 700, and/or 1100. In FIG. 15, grip 1500 is in the extended or use position and can be pressed down when not in use. Grip 1500 may or may not be removable from protective case 110. One or more of a user's fingers may be extended through the opening between bendable strips 1530 for improving the user's grip on the assembly and/or reducing the chances of dropping it. In addition, another accessory, such as a wireless charger, may alternately be placed between bendable strips 1530 and under the cap. This configuration may enable the wireless charger to be closer to the back of the electronic device than it would be if grip 1500 was in the stowed position and the wireless charger was on top of the stowed grip.

Figure 16:
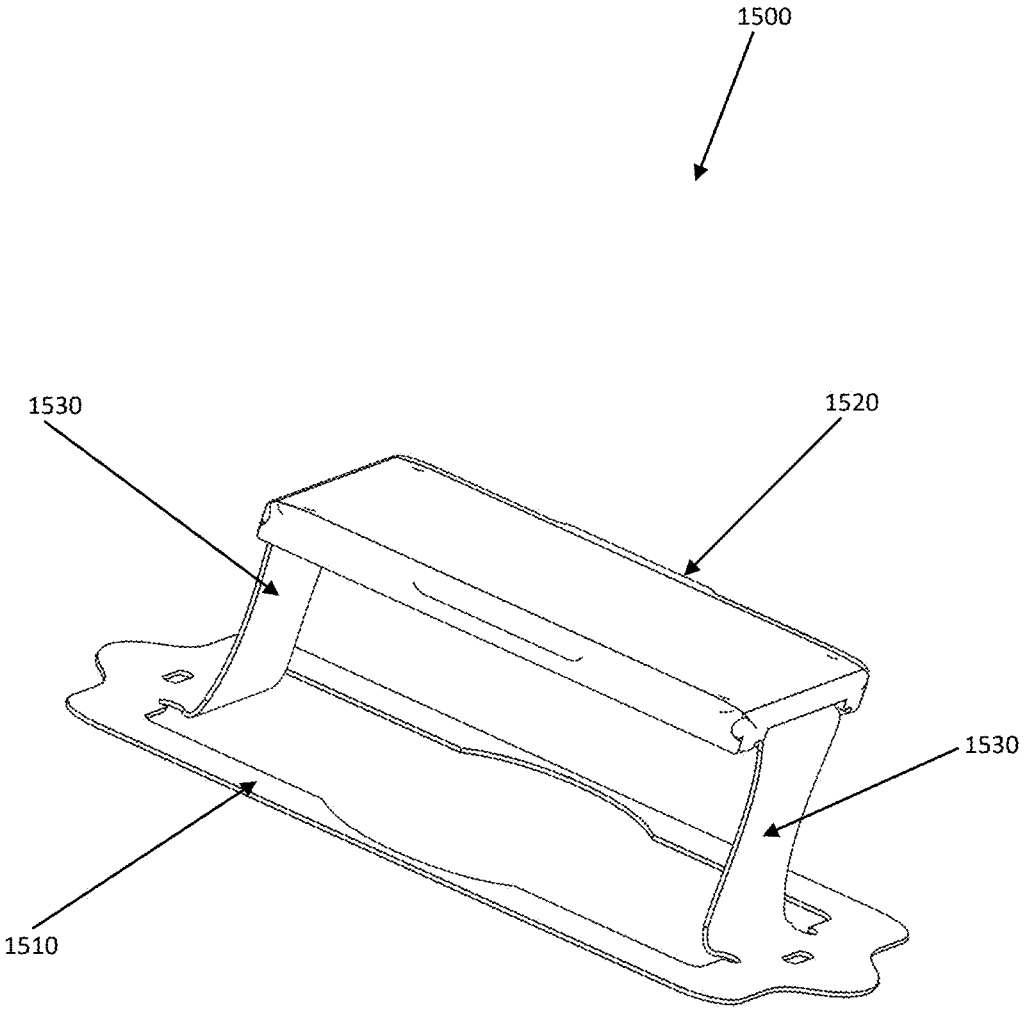
FIG. 16 illustrates the device grip of FIG. 15.

FIG. 16 illustrates grip 1500 without protective case 110. Cap 1520 and bendable strips 1530 are similar to cap 1120 and bendable strips 1130, respectively, of grip 1100. However, grip 1500 does not necessarily contain the same configuration of base and slots as other grips disclosed herein. Bendable strips 1530 are each attached to a frame 1510 which holds them in position. Frame 1510 and bendable strips 1530 may be formed, molded, punched, or die-cut from a single piece of material rather than being separate components. In another example, they may contain a stack of two or more materials to accomplish a variety of characteristics including strength, rigidity, flexibility, durability, stiffness, resilience, and/or smoothness. In other examples, they many be made of different materials.

Beneficially, the grip structure illustrated in FIG. 16 may provide a thin structure. Height reduction allows grip 1500 to protrude less from the back of an electronic device or from a case when grip 1500 is stowed and not in use. Grip 1500 may be somewhat flush, substantially flush, or completely flush with a back surface of the protective case. This minimizes the chance of grip 1500 catching on pockets, edges of bags, etc. when not in use and makes the assembly generally easier to store. It also permits a wireless charger to be closer to the back surface of the installed electronic device without removing grip 1500 and/or the protective case thereby improving wireless charging performance. Other types of grips may have to be removed for wireless charging.

Figure 17:
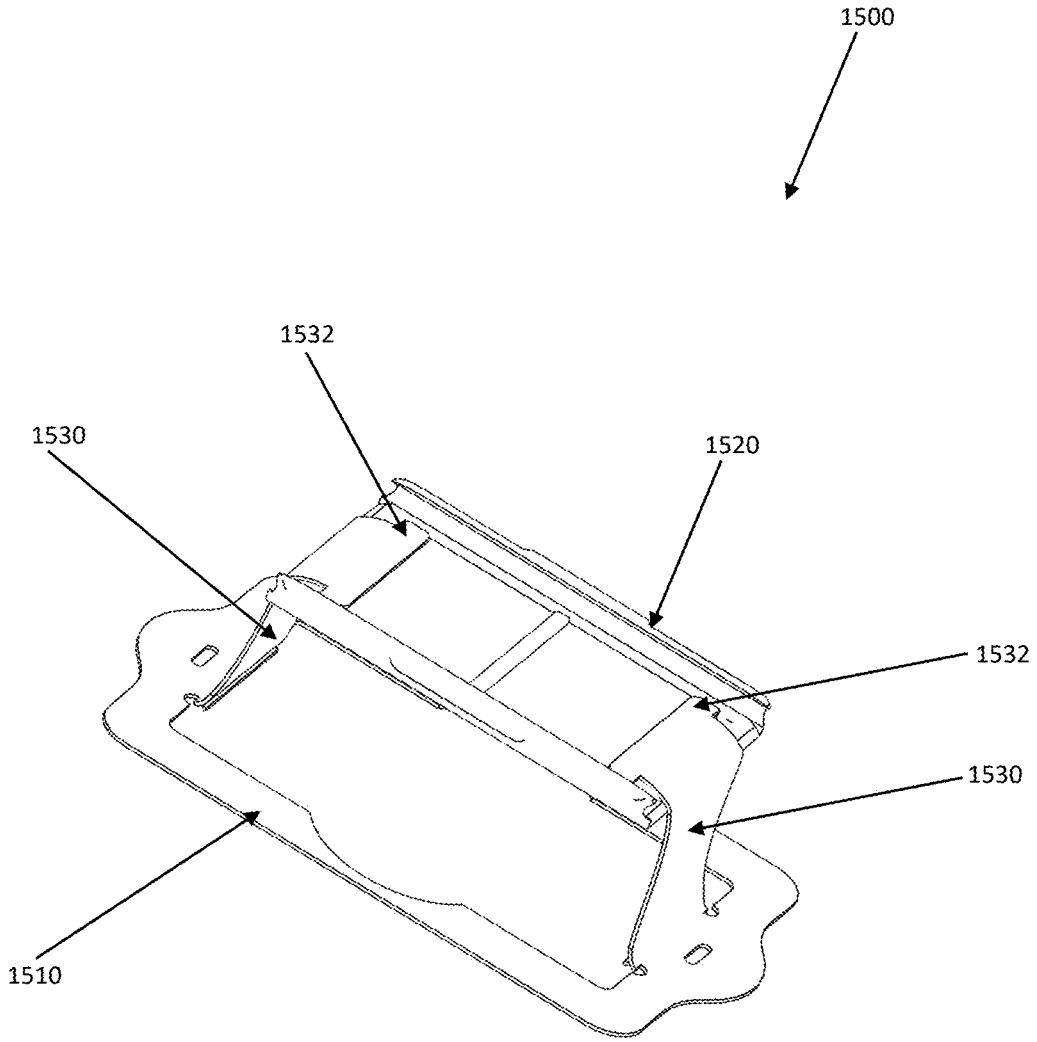
FIG. 17 illustrates a portion of the device grip of FIG. 16.

FIG. 17 illustrates grip 1500 of FIG. 16 with a top portion of cap 1520 removed. In this view, the ends of bendable strips 1530 inside cap 1520 are visible, including stop features 1532 which prohibit bendable strips 1530 from being pulled out of or exiting cap 1520 entirely. In this way, the extension of cap 1520 from frame 1510 is limited to a particular length or distance. When transitioned to the stowed or retracted position, bendable strips 1530 extend into cap 1520 until cap 1520 is against, or substantially close to, frame 1510. Frame 1500 may be attached to an internal surface of a protective case such that grip 1500 extends through an aperture of the protective case and/or frame 1500 may be attached to another element which is attached to an internal surface of a protective case such that grip 1500 extends through an aperture of the protective case.

Figure 18:
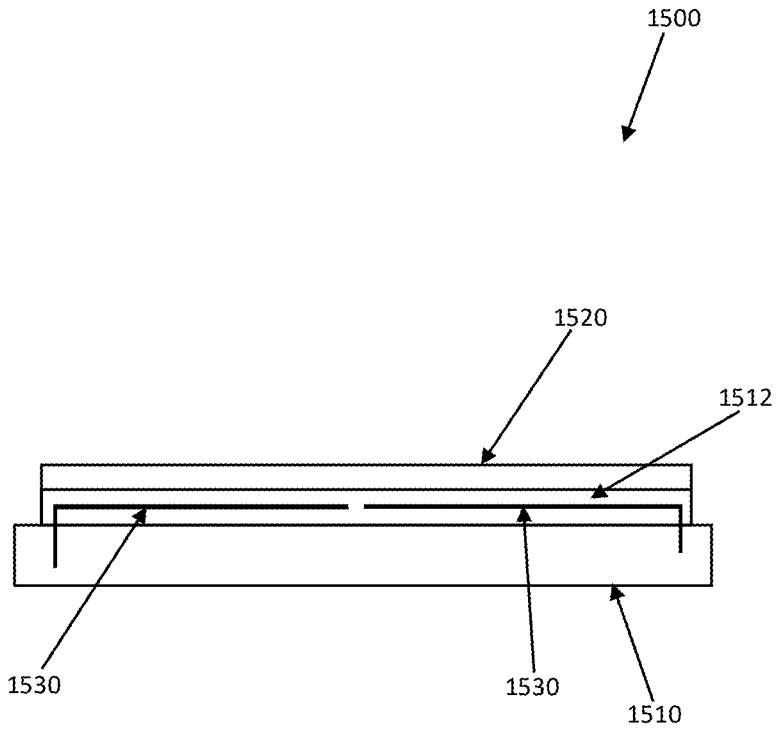
FIG. 18 illustrates a side sectional view of a device grip.

FIG. 18 illustrates a side sectional view of grip 1500. Cap 1520 is illustrated in the stowed or retracted position. Cap 1520 may also be referred to as a top, a top portion, or a button. As illustrated in FIGS. 15-17, cap 1520 may be extended into the extended or use position. The elements of grip 1500 are illustrated in FIG. 18 with basic shapes for purposes of explanation of the operation of grip 1500. However, it should be understood that any of the elements of grip 1500 may have different shapes or sizes while retaining similar functionality. Further, any of the elements disclosed herein may be made from a single component or may be made up of multiple components.

Bendable strips 1530 are attached near ends or edges of base 1510. Bendable strips 1530 may include any of the features, functions, elements, or characteristics of bendable strips 330, 730, or 1130. Bendable strips 1530 may be formed from any relatively thin flexible and/or bendable material that is substantially flat and tends to return to its substantially flat state after being bent. Bendable strips 1530 may be formed from a plastic film, from plastic, from a thin metallic strip, or from another material. In some examples, bendable strips 1530 may have some cross-sectional curvature, similar to a metal measuring tape, which further causes them to have a tendency to return to a straight or flat position. Bendable strips 1530 may also be referred to as a strip, strap, bendable strap, arm, bendable arm, or extension arm. In FIG. 18, bendable strips 1530 appear as lines because they are being viewed from the side. Bendable strips 1530 are positioned in a slot 1512 of cap 1520 and slide in and out of cap 1520 as illustrated in FIGS. 15-17. Similar to grip 1100, bendable strips 1530 extend from opposite sides or outer edges of the device. However, in grip 1500 bendable strips 1530 have a fixed attachment to base 1510 and slide in and out of one or more slots 1512 in cap 1520 to provide the travel or movement between the extended position and the stowed position.

Slot 1512 may also be referred to as a cavity or a channel. In some examples, slot 1512 may not be fully enclosed and may be formed as a channel in a surface with extensions which extend over the channel only partially to retain bendable strips 1530 in the channel. In some examples, methods other than those illustrated in FIGS. 4, 6, 8, 10, 12, and 14 may be used to limit the travel or distance of movement of the bendable strip(s). In one example, the bendable strip(s) may include a slot and the cap or base may include one or more posts that extend through the slot such that the post(s) travel through the range of the slot of the bendable strip when the bendable strip is moved.

Figure 19:
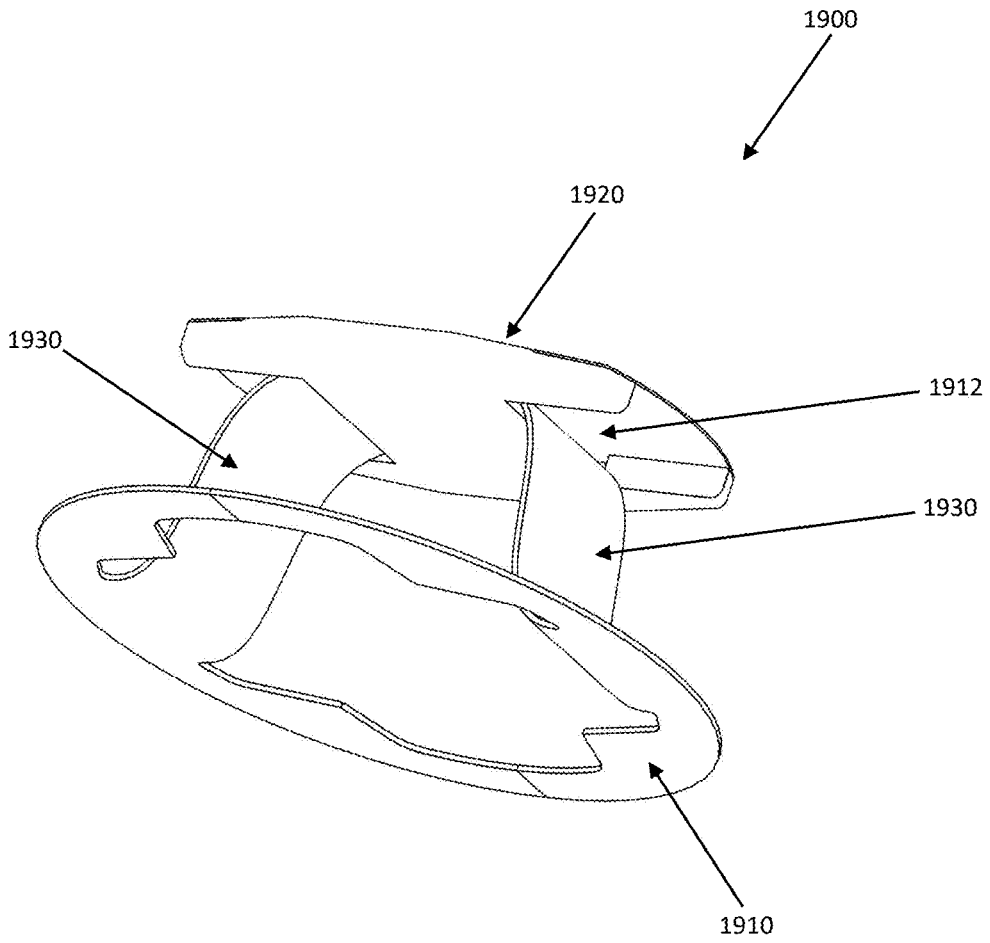
FIG. 19 illustrates the device grip of FIG. 19.

FIG. 19 illustrates a grip 1900 having some similarities to grip 1500. Cap 1920 and bendable strips 1930 are similar to cap 1520 and bendable strips 1530, respectively, of grip 1500. Similar to grip 1500, bendable strips 1930 have a fixed attachment to a lower frame 1910 and slide in and out of cap 1920 to achieve the extension and retraction movements. Frame 1910 and bendable strips 1930 may be formed, punched, or die-cut from a single piece of material. In another example, they may comprise a stack of two or more materials to accomplish a variety of characteristics including strength, rigidity, flexibility, durability, stiffness, resilience, and/or smoothness. Frame 1910 may be temporarily or permanently adhered to a case or to an electronic device. Alternately, frame 1910 may be otherwise adhered to or captured by a case or by an electronic device.

Figure 20:
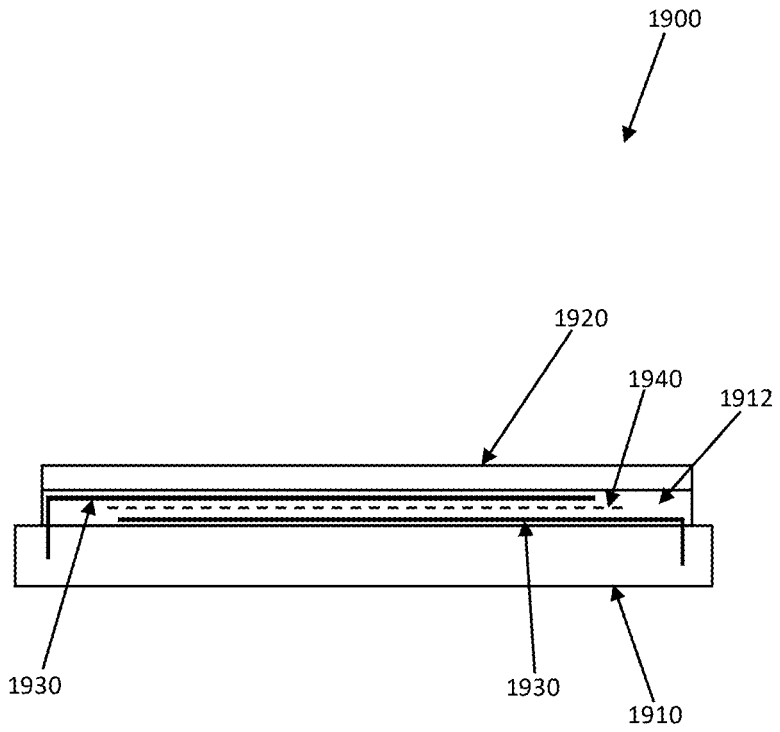
FIG. 20 illustrates a side sectional view of a device grip.

FIG. 20 illustrates a side section view of grip 1900 in the stowed position. The structure and movement of grip 1900 has similarities to grip 1500 as illustrated in FIG. 18 in that the bendable strips slide in and out of the cap from opposite directions. However, in grip 1900 the two bendable strips 1930 are overlapped in cap 1920 such that one slides above the other. They may have length such that some overlap still exists when they are in the extended position in order to maintain the orientation between them. This configuration allows the overall length or size of grip 1900 to be reduced. In some examples, grip 1900 may optionally include a divider 1940 which is a thin piece of film or other material that separates the bendable strips 1930 so they are not sliding directly against each other. In one variation, the two bendable strips 1930 may be a single strip that retracts into a collapsed "S" shape inside cap 1920.

Figure 21:
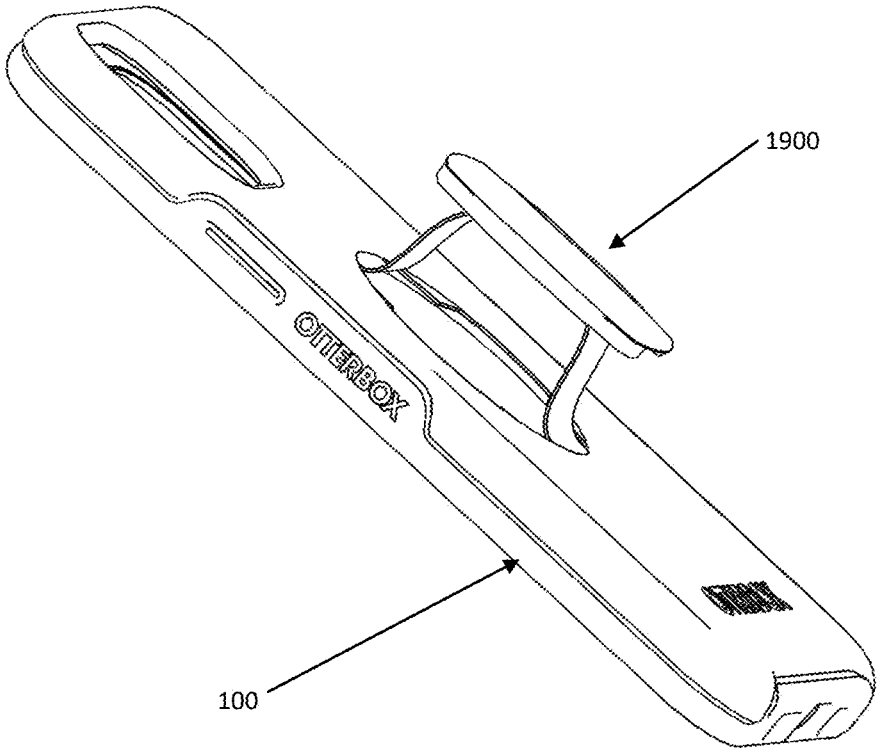
FIG. 21 illustrates the device grip of FIG. 20 attached to a protective case.

FIG. 21 illustrates grip 1900 in protective case 100 and extending out of an opening or aperture in a back surface of protective case 100. When collapsed into the stowed position, grip 1900 may be flush, substantially flush, or nearly flush, and/or recessed relative to the back surface of protective case 100. In addition to handling and storage benefits, this geometry may also provide wireless charging performance for the installed electronic which is as good, or nearly as good, as the charging performance would be if the grip is not present because the wireless charger is able to be placed as close to the device as it could be were the grip not present. This provides a significant advantage over other solutions in which a grip must be removed for wireless charging. In some examples, any of the grips, grip apparatuses, or grip components disclosed herein may be manufactured from or include materials which preferred or increased magnetic permeability characteristics for improving the performance of a wireless charger by improving the magnet inductive coupling between the wireless charger and the electronic device which is inside the case on an opposite side of the grip.

Grip 1900 may be permanently or temporarily attached to protective case 100 from one side, both sides, or either side. Grip 1900 may be attached with an adhesive, magnets, a friction fit, an interference fit, a tab, a groove, a clip, a mechanical fastener, co-molding, a hook-and-loop fastener, a snap, and/or a rotational attachment mechanism. In some examples, any of the grips disclosed herein may be sized to fit within a particular feature or dimension of the electronic device and/or the protective case. In one specific example, any of the grip assemblies disclosed herein may fit within the circular shape of the APPLE MAGSAFE magnet array. In this way, the grip has minimal impact on the performance or use of the MAGSAFE interface. The flush and/or low profile grips disclosed herein may also result in the grip having little or no effect on the magnet attraction features of such an interface. For example, the flush and/or low profile grips disclosed herein may also enable the device and/or case to be attached to a magnetic desk or car mount without removing the grip. In other examples, any of the grips or cases disclosed herein may also include one or more magnets for establishing a magnetic interface with other devices or for enhancing an existing magnetic interface.

Figure 22:
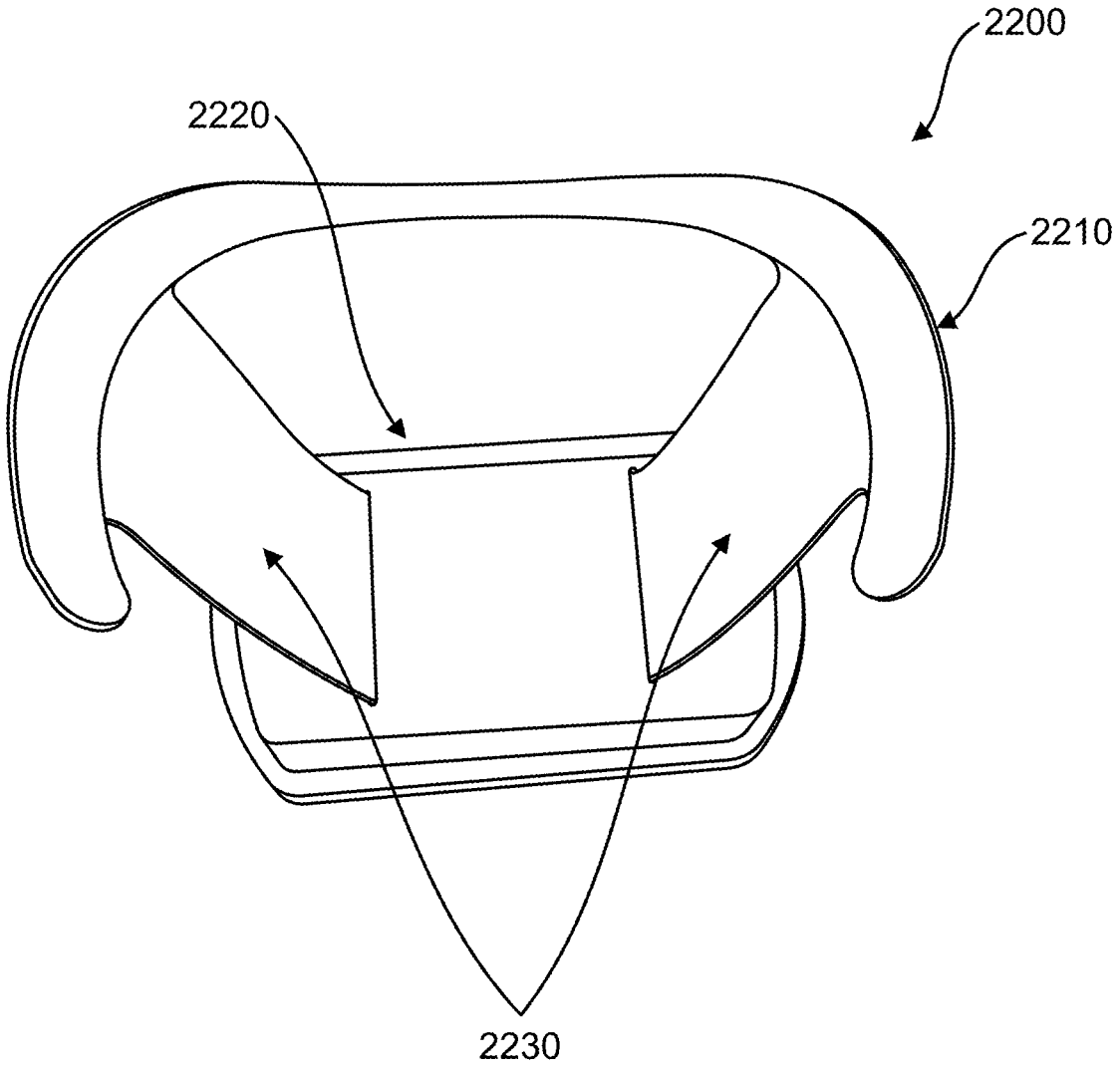
FIG. 22 illustrates a bottom view of a device grip in the extended position.

FIG. 22 illustrates a bottom view of a grip 2200 in the extended position. Grip 2200 has similarities to and may include any of the elements, features, or characteristics of the other grip devices disclosed herein. Cap 2220 is similar to cap 1520 and other caps disclosed herein. Frame 2210, which may also be referred to as a base, is similar to other frames disclosed herein, such as frame 1910, but does not have a complete or closed circumference. In other words, frame 2210 has a gap or opening in its perimeter edge. As discussed with respect to subsequent figures, the opening in frame 2210 facilitates installation into another object. Bendable strips 2230 are similar to bendable strips 1530 of grip 1500. Bendable strips 2230 have a fixed attachment to frame 2210 and/or are formed from a same piece of material as frame 2210, but may be formed from a different material in some examples. Bendable strips 2230 slide in and out of cap 2220 to achieve the extension and retraction movements as discussed in prior examples.

Figure 23:
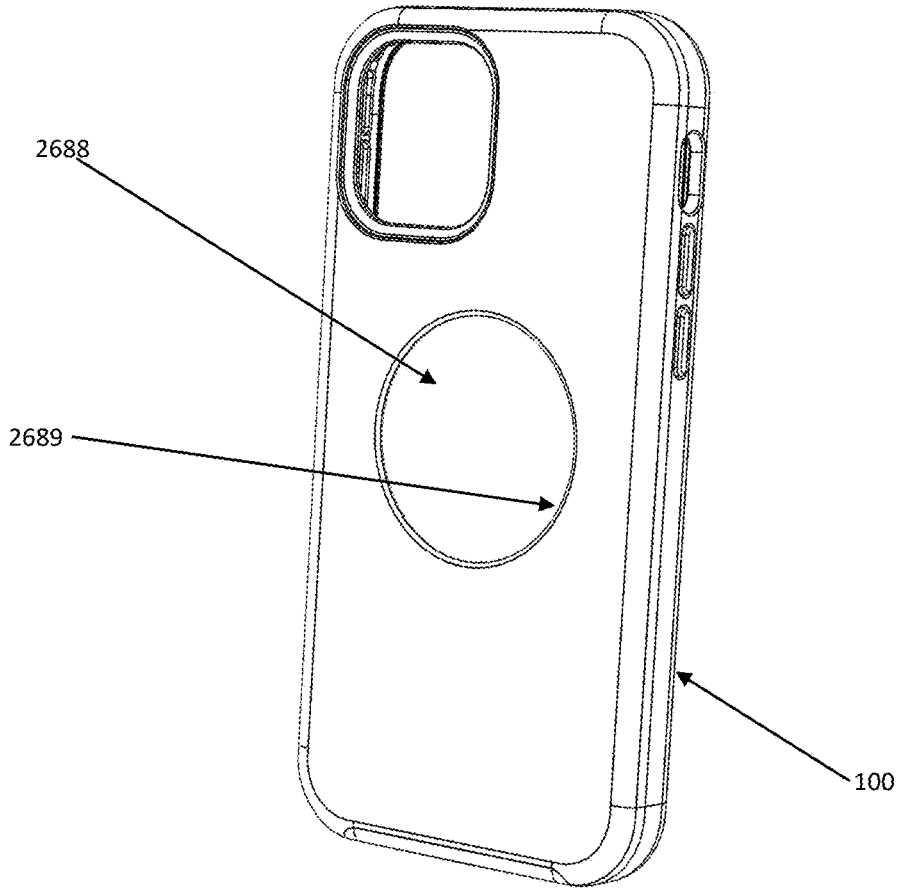
FIG. 23 illustrates a protective case for use with a grip.

FIG. 23 illustrates protective case 100 with an opening 2688 for receiving any of the grips, grip apparatuses, or holders disclosed herein. Opening 2688 may also be referred to as a cavity. Opening 2688 may extend all the way through the back wall of protective case 100 or may be a recess or cavity with a bottom where it does not extend all the way through the back wall of protective case 100. In the example of FIG. 23, opening 2688 is circular and has a specified diameter. In other examples, opening 2688 may have a different shape. Opening 2688 includes a lip 2689 around some or all of the diameter of opening 2688. The cavity of opening 2688 extends back under the edge of lip 2689 such that such that a grip or other object can expand into the cavity under the lip and be attached to protective case 100.

Figure 24:
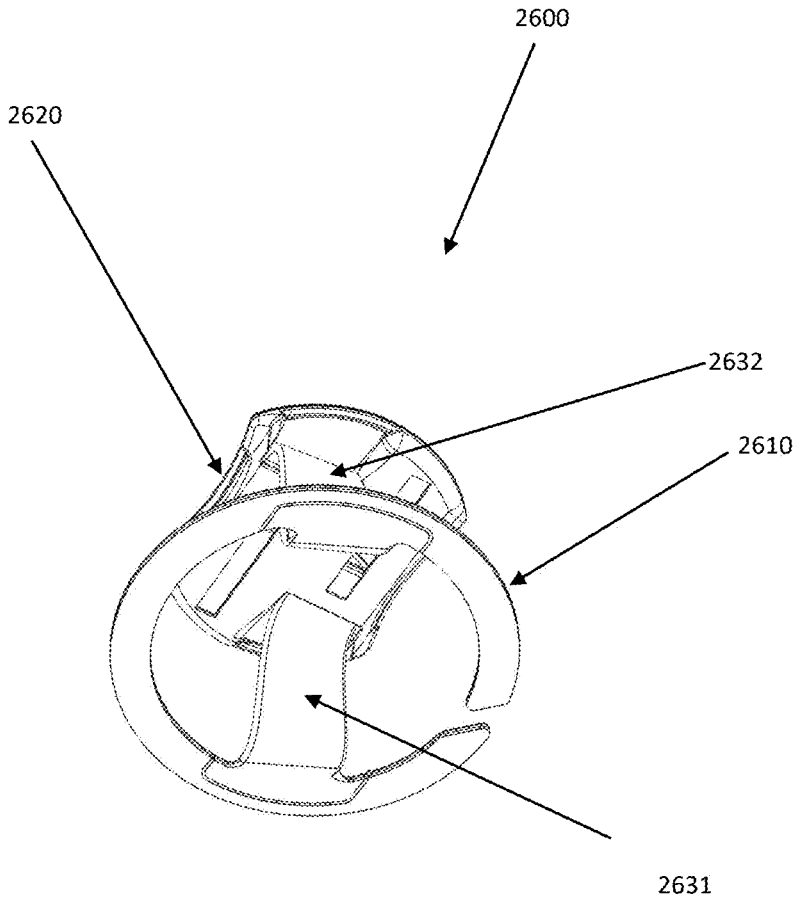
FIG. 24 illustrates a bottom perspective view of a grip in the extended position.

FIG. 24 illustrates a bottom view of a grip 2600 in the extended position. Grip 2600 has similarities to and may include any of the elements, features, or characteristics of the other grip devices disclosed herein. Cap 2620 is similar to cap 1520, cap 2220, and/or other caps disclosed herein. Frame 2610 is similar to other frames disclosed herein, such as frame 1910, frame 2210, and/or others. Grip 2600 also includes bendable strips 2631 and 2632 which may be similar to bendable strips 1530 of grip 1500 and/or bendable strips 2230 of grip 2200. Bendable strips 2631 and 2632 have a fixed attachment to frame 2610 and/or are formed from a same piece of material as frame 2610. Bendable strips 2631 and 2632 may also be formed from a different material than frame 2610. Bendable strips 2631 and 2632 slide in and out of cap 2620 to achieve the extension and retraction movements similar to those discussed in prior examples. Unlike prior examples, bendable strips 2631 and 2632 are configured to be side-by-side with each other or side adjacent to each other in cap 2620 rather than sliding one over the other as illustrated in FIG. 22. Grip 2600 may include fewer or more bendable strips.

Figure 25:
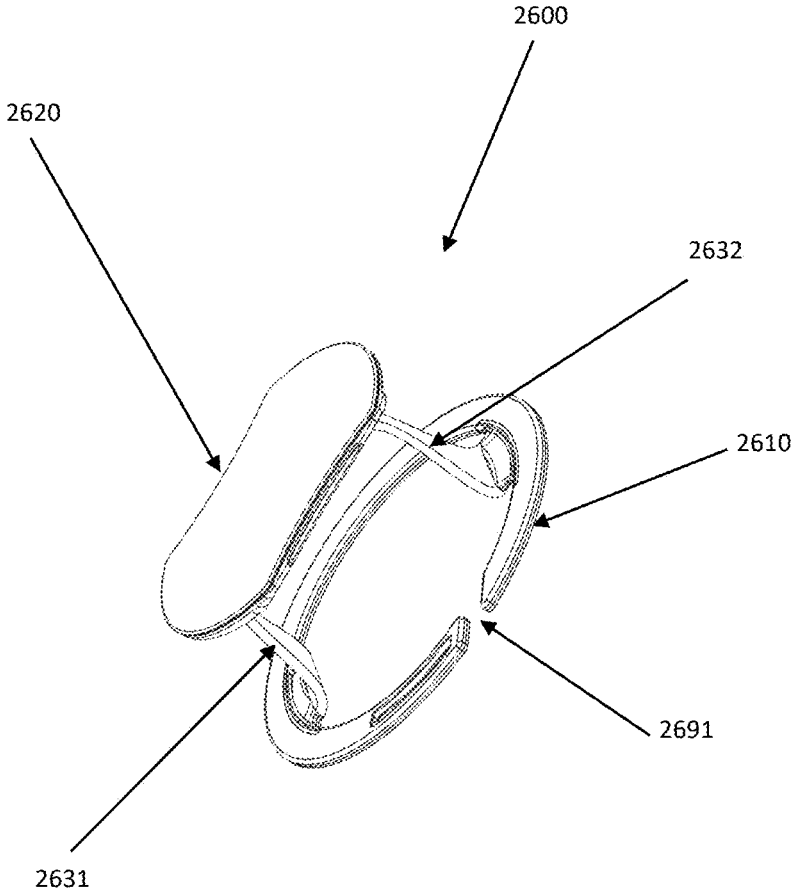
FIG. 25 illustrates an alternate view of the grip of FIG. 24.

FIG. 25 illustrates an alternate view of grip 2600 of FIG. 25. Frame 2610, which may also be referred to as a base, includes a gap 2691 in the circumference. Gap 2691 may also be referred to as a break or a discontinuity. In FIG. 25, frame 2610 is in a relaxed state and has a specified diameter. When an external force is temporarily applied to framed 2610 it can be squeezed or compressed to reduce or close gap 2691 and temporarily reduce the dimension or diameter of frame 2610 so it can fit into a smaller opening, such as opening 2688 of protective case 100 in FIG. 23. When the external force is removed, frame 2610 will relax or return to the original diameter (illustrated in FIG. 25) and it will expand under lip 2689 thereby temporarily attaching, affixing, or retaining grip 2600 to protective case 100 until it is intentionally removed by applying a similar force again.

Figure 26:
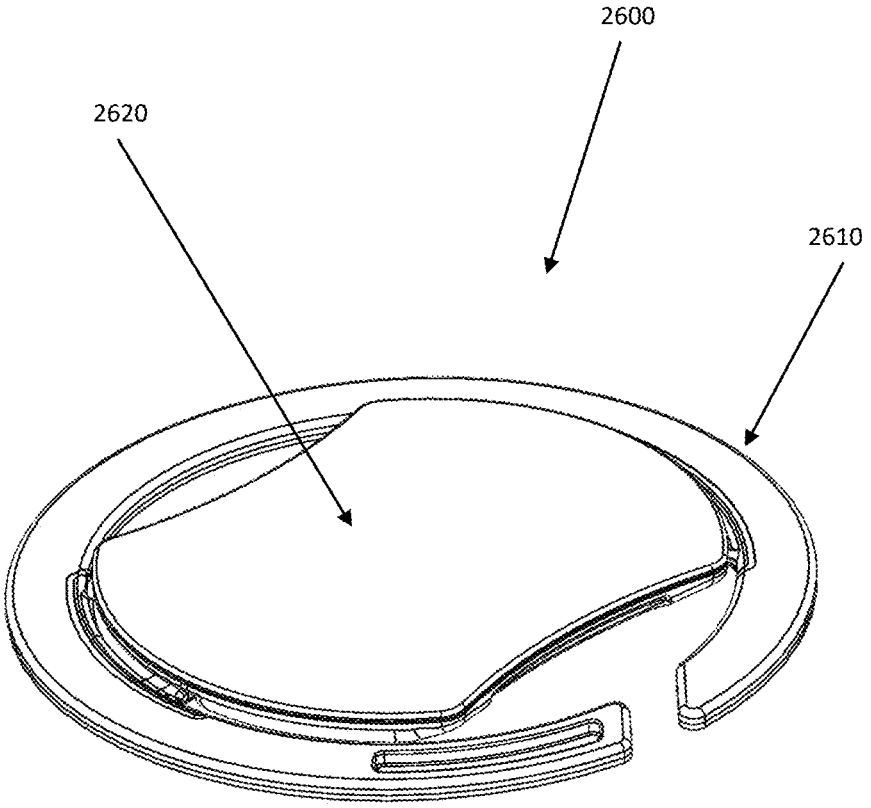
FIG. 26 illustrates a top perspective view of the grip of FIG. 24 in the stowed position.

FIG. 26 illustrates grip 2600 of FIGS. 24 and 25 in the collapsed or stowed position. Cap 2620 may have a variety of shapes to facilitate use as a grip. Cap 2620 may be round, oval, square, or rectangular. Further, cap 2620 may have a shape or features to fit into opening 2688 when in the stowed position. Some or all of cap 2620 may have an arced or circular ship to match at least a portion of opening 2688. In the example of FIG. 26, cap 2620 may also have one or more sections which leave one or more portions of opening 2688 accessible even when it is in the stowed position. These areas may make it easier for a user to get a fingertip or fingernail under an edge of cap 2620 to make it easier to pull it to the extended or use position. More specifically, the sides of cap 2620 may form an hourglass shape to provide more fingertip room while still maintaining the overall width of cap 2620. Other shapes are possible.

Figure 27:
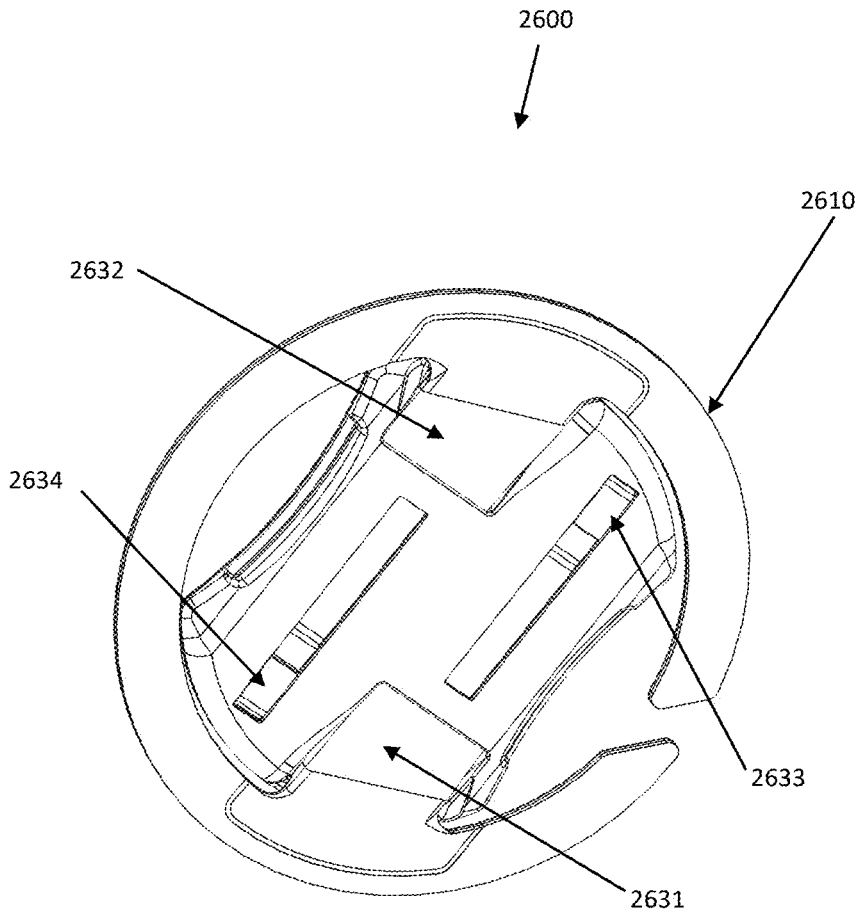
FIG. 27 illustrates a bottom perspective view of the grip of FIG. 24 in the stowed position.

FIG. 27 illustrates a bottom view of device grip 2600 of FIG. 26 in the stowed position. Bendable strips 2631 and 2632 are configured to be side-by-side with each other or side adjacent to each other, which may make it possible to make device grip 2600 thinner and/or flatter. Device grip 2600 may also include stop features such as stop features 2633 and 2634 which may limit a distance bendable strips 2631 and 2632 can be extended out of frame 2610 toward the extended position illustrated in FIG. 26.

Any of the bendable strips disclosed herein may be comprised of two or more layers of materials having different characteristics. In one example, a first material for the bendable strips may be selected based on desired rigidity, stiffness, bendability, resilience, durability, and/or strength characteristics. A stiffer material may tend to keep the device grip in one or more of the extended or stowed positions until an external force is applied to change the position. The first material may be overmolded, covered, or coated with a second material that provides different characteristics on one or more surfaces of the bendable strips. For example, the second material may be chosen to slide easily against other parts, to prevent binding, for user feel, for comfort, for softness, for scuff or scratch resistance, and/or for preferred color characteristics. The second material may cover or extend over the first material on one, two, or all sides of the bendable strip.

Figure 28:
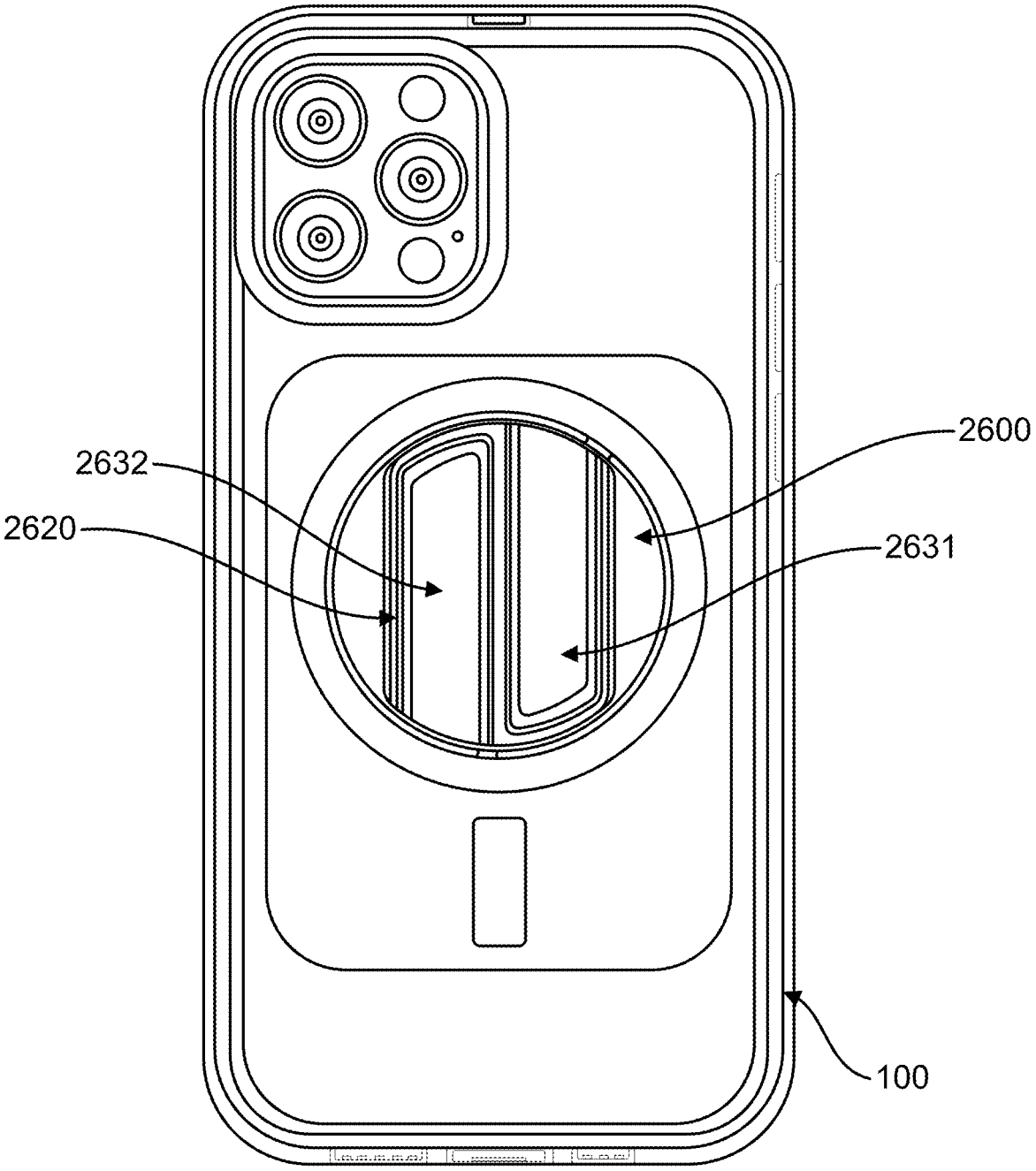
FIG. 28 illustrates the grip of FIG. 24 attached to a protective case and in the stowed position.
Figure 29:
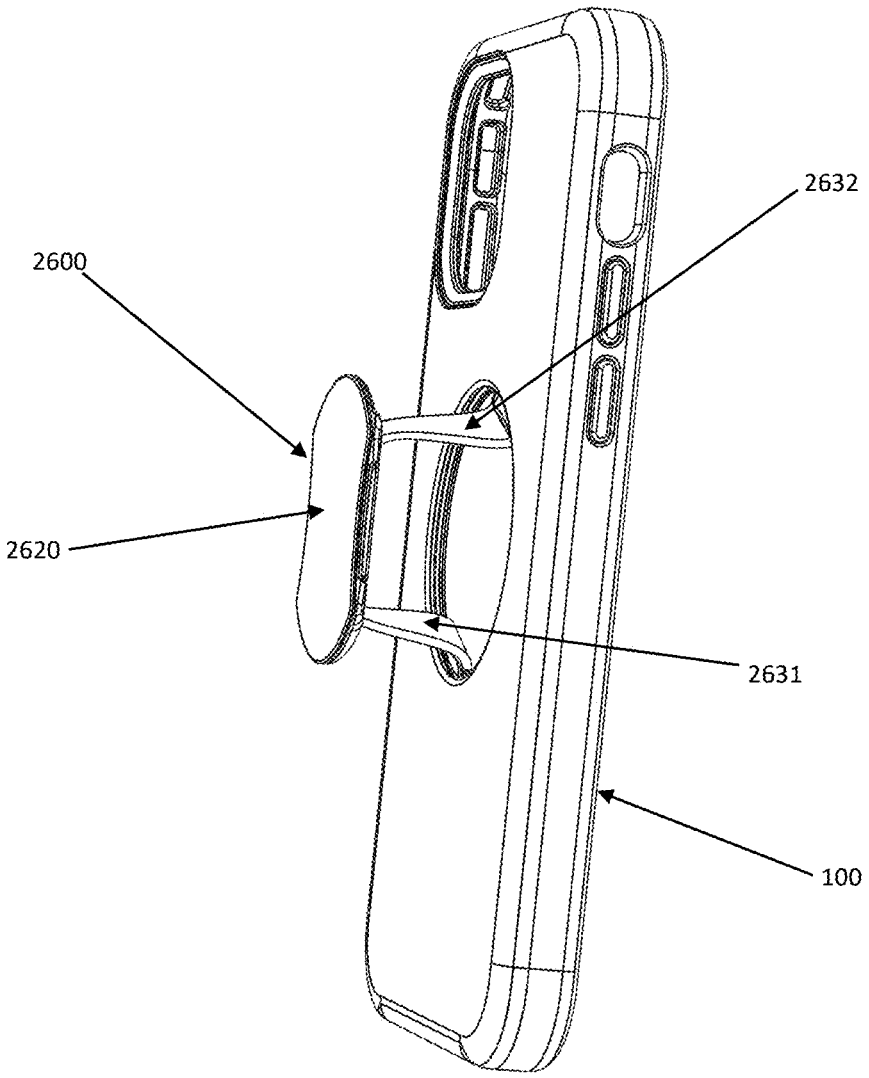
FIG. 29 illustrates an alternate view of the grip of FIG. 24 attached to a protective case and in the extended position.

FIG. 28 illustrates device grip 2600 of FIG. 27 attached to protective case 100 and in the stowed position. In the example of FIG. 28, cap 2620 is made from a clear or transparent material such that bendable strips 2631 and 2632 are visible inside, below, and/or through cap 2620. Device grip 2600 may attach to protective case 100 in a manner similar to that described with respect to FIGS. 24 and 25. FIG. 29 illustrates device grip 2600 attached to protective case 100 and in the extended position.

Figure 30:
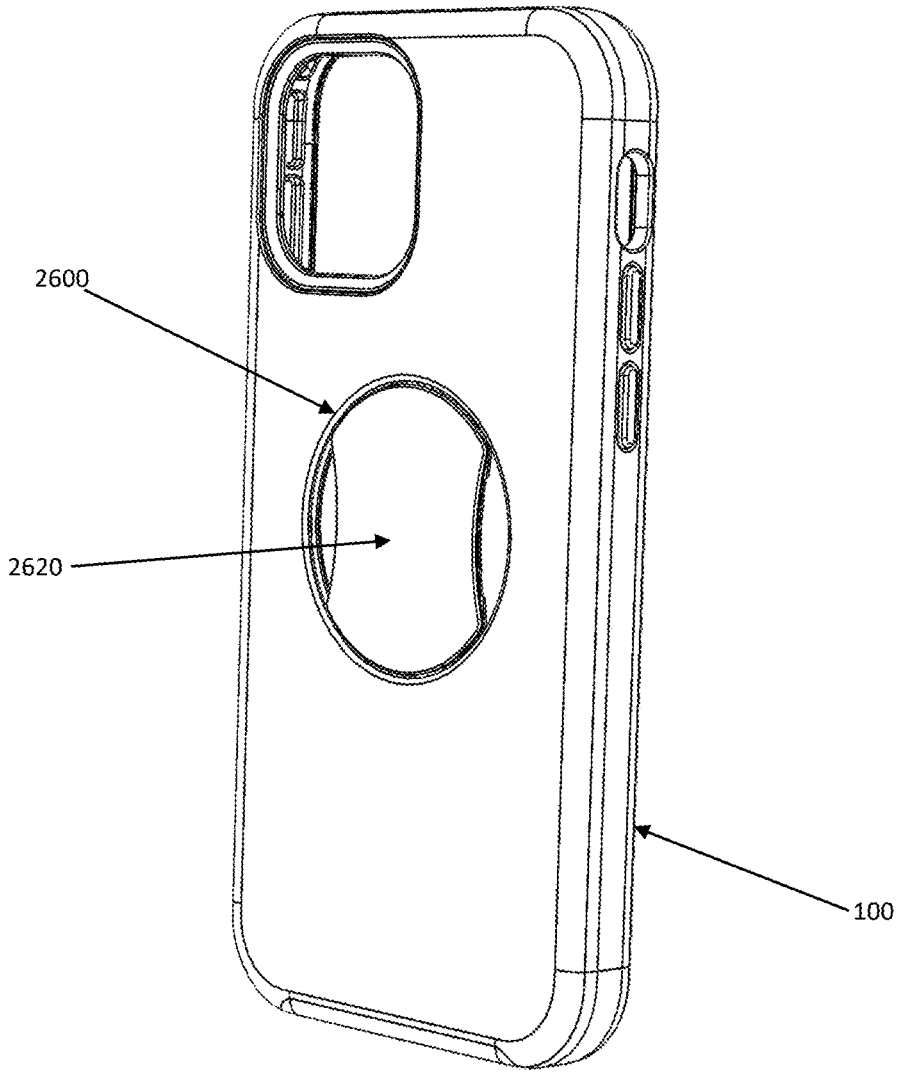
FIG. 30 illustrates an alternative view of the grip of FIG. 24 attached to a protective case and in the stowed position.
Figure 31:
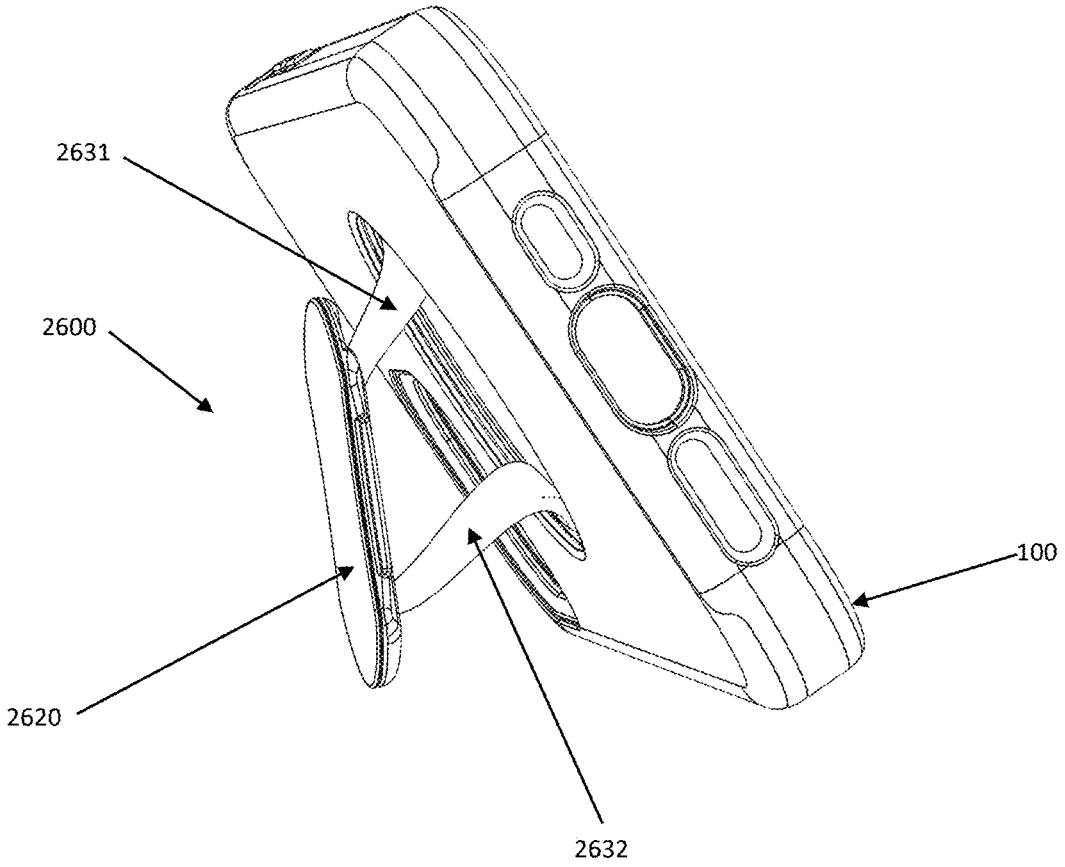
FIG. 31 illustrates the grip and protective case of FIG. 29 in a stand orientation.

FIG. 29 illustrates an alternate view of the grip of FIG. 24 attached to a protective case and in the extended position. FIG. 30 illustrates the protective case and grip of FIG. 29 in the stowed position. FIG. 31 illustrates the grip and protective case of FIGS. 29 and 30 in a stand orientation for use on a table, desk, or other substantially horizontal surface. Grip 2600 may be rotated to a preferred position depending on which orientation is preferred for protective case 100. Also, grip 2600 may be partially extended on one or more sides, as illustrated in FIG. 31, in order to achieve a different stand angle. In some examples, grip 2600 may also be used to attach the assembly to another object such as a wall mount or a car mount.

In some examples, any of the grips or holders disclosed herein may be substantially flush, or even recessed, when in the stowed position such that another feature is helpful when extending the grip. Any of the grips or holders disclosed herein may include a small cutout, recess, or edge for lifting the grip with a fingernail or other small object, such as a coin. In other examples, the grip may rock or pivot when in the stowed position and pressure is applied to an edge in order to temporarily raise and provide access at an opposing edge for extending the grip.

Some additional possible embodiments of the disclosed grips and cases are outline in the paragraphs which follow.

A grip apparatus for facilitating holding of an electronic device, the grip apparatus comprising a base having a bottom surface and a top surface, wherein the bottom surface is configured for attachment to the electronic device or to a protective case for the electronic device, wherein the base includes two linear channels between the top surface and the bottom surface, wherein the base further includes two apertures in the top surface, wherein each aperture extends from the top surface of the base to a respective one of the linear channels; two extension arms each formed from a semi-rigid bendable material, wherein each extension arm includes first and second ends and is configured to slide, at least partially, within a respective one of the linear channels, wherein the first end of each extension arm extends through a respective one of the apertures in the top surface of the base, wherein each extension arm is configured to extend out of the aperture to an extended position and retract into the respective one of the linear channels to a retracted position when the extension arm slides within the linear channel, and wherein a stop at the second end of each extension arm establishes a maximum extension length and prevents the extension arm from fully exiting the linear channel through the respective aperture when at the extended position; and a cap attached to the first end of each extension arm, wherein the cap is configured to rest against one or more fingers of a user holding the electronic device, wherein the cap is proximate the top surface of the base when the extension arms are in the retracted positions, and wherein the cap and the extension arms extend away from the top surface of the base in a substantially perpendicular direction when the cap is pulled outward and the extension arms moved toward the extended positions.

A grip apparatus wherein the cap is rotatable relative to the attached extension arms.

A grip apparatus of wherein each of the extension arms comprises a strip of the semi-rigid bendable material that is substantially planar when in a relaxed state.

A grip apparatus wherein each of the extension arms must bend to extend out of the respective linear channel through the respective aperture when moved toward the extended position.

A grip apparatus wherein the two apertures are proximate each other and the extension arms slide out of the linear channels in opposite directions.

A grip apparatus wherein portions of the bent extension arms extending beyond the respective apertures press against each other above the top surface.

A grip apparatus wherein each of the extension arms returns, at least partially, to the substantially planar relaxed state in the respective linear channel when in the retracted position.

A grip apparatus wherein the substantially planar relaxed state tends to hold the cap in the retracted position until an external force is applied to pull the cap outward.

A grip apparatus further comprising an adhesive for adhering the bottom surface of the base to the electronic device or to the protective case.

A grip apparatus further comprising an attachment mechanism for removably attaching the grip apparatus to the protective case.

A grip apparatus wherein the cap is further configured to act as a stand when in the extended position to hold the electronic device in a viewing position.

A grip apparatus wherein the cap is pivotably attached to the first ends of the extension arms.

A grip apparatus wherein the semi-rigid bendable material is a plastic film.

A grip apparatus wherein the extension arms are in the relaxed substantially planar state when in the extended positions.

A grip apparatus wherein the extension arms are in the relaxed substantially planar state when in the retracted positions.

A grip device for facilitating holding of an electronic device, the grip device comprising: a base having a bottom surface and a top surface, wherein the bottom surface is adapted for attachment to the electronic device or for attachment to a protective case for the electronic device, wherein the base includes two slots and two apertures at the top surface, wherein each aperture extends from the top surface of the base into a respective one of the slots; two arms each formed from a bendable material, wherein each arm includes first and second ends and is adapted to slide, at least partially, within a respective one of the slots, wherein the first end of each arm extends through a respective one of the apertures in the top surface of the base, wherein each arm is adapted to extend out of the aperture to an extended position and retract into the respective one of the slots to a retracted position when the arm slides within the respective slot, and wherein a stop at the second end of each arm establishes a maximum extension length and prevents the arm from fully exiting the slot through the respective aperture; and a cap attached to the first end of each arm, wherein the cap is adapted to assist a user in holding the electronic device, wherein the cap is proximate the top surface of the base when the arms are in the retracted positions, and wherein the cap and the arms extend away from the top surface of the base in a substantially perpendicular direction when the cap is pulled outward and the arms transition to the extended positions.

A grip device wherein the cap is rotatable relative to the attached arms.

A grip device wherein each of the arms comprises a strip of the bendable material that is substantially planar when in a relaxed state.

A grip device wherein each of the arms must bend to extend out of the respective slot through the respective aperture when moved toward the extended position.

A grip device wherein the two apertures are proximate each other and the arms slide out of the slots in opposite directions.

A grip device wherein portions of the bent arms extending beyond the respective apertures press against each other above the top surface.

A grip device wherein each of the arms returns, at least partially, to the substantially planar relaxed state in the respective slot when in the retracted position.

A grip device wherein the substantially planar relaxed state tends to hold the cap in the retracted position until an external force is applied to pull the cap outward.

A grip device further comprising an adhesive for adhering the bottom surface of the base to the electronic device or to the protective case.

A grip device further comprising an attachment mechanism for removably attaching the grip device to the protective case.

A grip device wherein the cap is further adapted to act as a stand when in the extended position to hold the electronic device in a viewing position.

A grip device wherein the cap is pivotably attached to the first ends of the arms.

A grip device wherein the bendable material is a plastic film.

A grip device wherein the arms are in the relaxed substantially planar state when in the extended positions.

A grip device wherein the arms are in the relaxed substantially planar state when in the retracted positions.

A protective case for an electronic device, the protective case comprising: a protective shell for receiving the electronic device and covering at least a portion of a housing of the electronic device, wherein the protective shell includes two internal slots and two apertures at a back surface of the protective shell, wherein each aperture extends from the back surface into a respective one of the slots; two arms each formed from a bendable material, wherein each arm includes first and second ends and is adapted to slide, at least partially, within a respective one of the slots, wherein the first end of each arm extends through a respective one of the apertures, wherein each arm is adapted to extend out of the aperture to an extended position and retract into the respective one of the slots to a retracted position when the arm slides within the respective slot, and wherein a stop at the second end of each arm establishes a maximum extension length and prevents the arm from fully exiting the slot through the respective aperture; and a cap attached to the first end of each arm, wherein the cap is adapted to assist a user in holding the protective case, wherein the cap is adjacent the back surface of the protective case when the arms are in the retracted positions, and wherein the cap and the arms extend away from the back surface of the protective case in a substantially perpendicular direction when the cap is pulled outward and the arms transition to the extended positions.

A protective case wherein the cap is rotatable relative to the attached arms.

A protective case wherein each of the arms comprises a strip of the bendable material that is substantially planar when in a relaxed state.

A protective case wherein each of the arms must bend to extend out of the respective slot through the respective aperture when moved toward the extended position.

A protective case wherein the two apertures are proximate each other and the arms slide out of the slots in opposite directions.

A protective case wherein portions of the bent arms extending beyond the respective apertures press against each other above the back surface.

A protective case wherein each of the arms returns, at least partially, to the substantially planar relaxed state in the respective slot when in the retracted position.

A protective case wherein the substantially planar relaxed state tends to hold the cap in the retracted position until an external force is applied to pull the cap away from the back surface.

A protective case wherein the cap is further adapted to act as a stand when in the extended position to hold the protective case in a viewing position.

A protective case wherein the cap is pivotably attached to the first ends of the arms.

A protective case wherein the bendable material is a plastic film.

A protective case wherein the arms are in the relaxed substantially planar state when in the extended positions.

A protective case wherein the arms are in the relaxed substantially planar state when in the retracted positions.

A protective case wherein the cap is removable.

A protective case wherein the arms include contours for accommodating fingers of a user from multiple direction when the cap is in the extended position.

A protective case wherein the contours in the arms form an hourglass shape in the arms.

A protective case wherein the cap includes a surface for receiving a decorative feature or printing.

A protective case wherein the cap is interchangeable.

A protective case wherein the protective case is configured to engage a wireless charging device.

A protective case including one or more magnets.

A grip apparatus for facilitating holding of an electronic device, the grip apparatus comprising: a base having a bottom surface and a top surface, wherein the bottom surface is configured for attachment to the electronic device or to a protective case for the electronic device, wherein the base includes a linear channel between the top surface and the bottom surface, wherein the base further includes an aperture in the top surface, wherein the aperture extends from the top surface of the base into the linear channel; an extension arm formed from a semi-rigid bendable material, wherein the extension arm includes first and second ends and is configured to slide, at least partially, within the linear channel, wherein a center portion of the extension arm is accessible through the aperture in the top surface of the base, wherein the extension arm is configured to extend out of the aperture to an extended position and retract into the linear channel to a retracted position when the extension arm slides within the linear channel, and wherein each end of the extension arm includes a respective stop which establishes a maximum extension length and prevents the extension arm from fully exiting the linear channel when at the extended position; and a cap attached to the center portion of the extension arm, wherein the cap is configured to rest against one or more fingers of a user holding the electronic device, wherein the cap is proximate the top surface of the base when the extension arms are in the retracted positions, and wherein the cap and the extension arm extend away from the top surface of the base in a substantially perpendicular direction when the cap is pulled outward and the center portion of the extension arm is pulled out of the aperture toward the extended position.

A grip apparatus wherein the cap is rotatable relative to the attached extension arm.

A grip apparatus wherein the extension arm comprises a strip of the semi-rigid bendable material that is substantially planar when in a relaxed state.

A grip apparatus wherein the extension arm must bend to extend out of the linear channel through the aperture when moved toward the extended position.

A grip apparatus wherein the extension arms slide out of the linear channel toward a center from two directions.

A grip apparatus wherein the extension arm bends at approximately 180 degrees at the center portion when moved toward the extended position.

A grip apparatus wherein the extension arms returns, at least partially, to the substantially planar relaxed state in the linear channel when in the retracted position.

A grip apparatus wherein the substantially planar relaxed state tends to hold the cap in the retracted position until an external force is applied to pull the cap outward.

A grip apparatus further comprising an adhesive for adhering the bottom surface of the base to the electronic device or to the protective case.

A grip apparatus further comprising an attachment mechanism for removably attaching the grip apparatus to the protective case.

A grip apparatus wherein the cap is further configured to act as a stand when in the extended position to hold the electronic device in a viewing position.

A grip apparatus wherein the cap is pivotably attached to the extension arm.

A grip apparatus wherein the semi-rigid bendable material is a plastic film.

A grip apparatus wherein the extension arm is attached to the cap with a pin.

A grip apparatus wherein the extension arm is in the relaxed substantially planar state when in the retracted position.

A grip device for facilitating holding of an electronic device, the grip device comprising: a base having a bottom surface and a top surface, wherein the bottom surface is adapted for attachment to the electronic device or for attachment to a protective case for the electronic device, wherein the base includes a slot and an aperture at the top surface, wherein the aperture extends from the top surface of the base into the slot; an arm formed from a bendable material, wherein the arm includes first and second ends and is adapted to slide, at least partially, within the slot, wherein a center portion of the arm is extendable through the aperture in the top surface of the base, wherein the arm is adapted to extend out of the aperture to an extended position and retract into the slot to a retracted position when the arm slides within the slot, and wherein stops at the first and second ends of the arm establishes a maximum extension length and prevents the arm from fully exiting the slot; and a cap attached to the center portion of the arm, wherein the cap is adapted to assist a user in holding the electronic device, wherein the cap is proximate the top surface of the base when the arm is in the retracted position, and wherein the cap and the arm extend away from the top surface of the base in a substantially perpendicular direction when the cap is pulled outward and the arm transitions to the extended positions.

A grip device wherein the cap is rotatable relative to the attached arm.

A grip device wherein the arm comprises a strip of the bendable material that is substantially planar when in a relaxed state.

A grip device wherein the arms must bend to extend out of the slot through the aperture when moved toward the extended position.

A grip device wherein the arm slides out of the slot from two directions toward the aperture when moved toward the extended position.

A grip device wherein the arm slides into the slot from two directions away from the aperture when moved toward the retracted position.

A grip device wherein the arm returns, at least partially, to the substantially planar relaxed state in the slot when in the retracted position.

A grip device wherein the substantially planar relaxed state tends to hold the cap in the retracted position until an external force is applied to pull the cap outward.

A grip device further comprising an adhesive for adhering the bottom surface of the base to the electronic device or to the protective case.

A grip device further comprising an attachment mechanism for removably attaching the grip device to the protective case.

A grip device wherein the cap is further adapted to act as a stand when in the extended position to hold the electronic device in a viewing position.

A grip device wherein the cap is pivotably attached to the center portion of the arm.

A grip device wherein the bendable material is a plastic film.

A grip device wherein the arm is in the relaxed substantially planar state when in the extended position.

A grip device wherein the arm is in the relaxed substantially planar state when in the retracted position.

A protective case for an electronic device, the protective case comprising: a protective shell for receiving the electronic device and covering at least a portion of a housing of the electronic device, wherein the protective shell includes an internal slot and an aperture at a back surface of the protective shell, wherein the aperture extends from the back surface into the slot near a center of the slot; an arm formed from a bendable material, wherein the arm is adapted to slide, at least partially, within the slot, wherein a center portion of the arm may be pulled out of the slot through the aperture, wherein the arm is adapted to extend out of the aperture to an extended position and retract into the slot to a retracted position when the arm slides in the slot, and wherein stop at the ends of the arm establishes a maximum extension length and prevents the arm from fully exiting the slot through the aperture; and a cap attached to the center portion of the arm, wherein the cap is adapted to assist a user in holding the protective case, wherein the cap is adjacent the back surface of the protective case when the arm is in the retracted position, and wherein the cap and the arm extends away from the back surface of the protective case in a substantially perpendicular direction when the cap is pulled outward and the arm transitions to the extended position.

A protective case wherein the cap is rotatable relative to the attached arm.

A protective case wherein the arm comprises a strip of the bendable material that is substantially planar when in a relaxed state.

A protective case wherein the arm must bend to extend out of the slot through the aperture when moved toward the extended position.

A protective case wherein two portions of the arm slide out of the slot and the aperture from opposite directions.

A protective case wherein the arm returns, at least partially, to the substantially planar relaxed state in the slot when in the retracted position.

A protective case wherein the substantially planar relaxed state tends to hold the cap in the retracted position until an external force is applied to pull the cap away from the back surface.

A protective case of wherein the cap is further adapted to act as a stand when in the extended position to hold the protective case in a viewing position.

A protective case wherein the cap is pivotably attached to the arm.

A protective case wherein the bendable material is a plastic film.

A protective case wherein the arm is in the relaxed substantially planar state when in the extended position.

A protective case wherein the arm is in the relaxed substantially planar state when in the retracted position.

A protective case wherein the cap is removable from the protective case

A grip device for facilitating holding of an electronic device, the grip device comprising: a base adapted for attachment to the electronic device or for attachment to a protective case for the electronic device; two bendable straps each formed from a bendable material, wherein each bendable strap includes a first end and a second end, wherein the first end of each bendable strap is attached to the base; and a cap adapted to assist a user in holding the electronic device or the protective case for the electronic device, wherein the cap is proximate a top surface of the base when in a stowed position, wherein the cap is extendable away from the top surface of the base in a substantially perpendicular direction when the cap is pulled outward to extend the cap to an extended position, wherein each bendable strap is adapted to slide, at least partially, within a respective slot of the cap, wherein the second end of each bendable strap slides into the respective slot when the grip device is transitioned to the stowed position and slides out of the respective slot when the grip device is transitioned to the extended position, and wherein a stop at the second end of each bendable strap establishes a maximum extension length and prevents the bendable strap from fully exiting the respective slot of the cap.

A grip device wherein the grip device is rotatable relative to the electronic device and/or the protective case.

A grip device wherein each of the bendable straps is substantially planar when in a relaxed state.

A grip device wherein each of the bendable straps must bend to slide into the respective slot of the cap when transitioning between positions.

A grip device wherein the two bendable straps are attached to opposing sides of the base.

A grip device wherein the two bendable straps enter the slots on opposing sides of the cap.

A grip device wherein the portions of the bendable straps in the slots in the cap are in substantially planar states.

A grip device wherein the substantially planar states of the bendable straps tend to hold the cap in the stowed position until an external force is applied to pull the cap outward.

A grip device further comprising an attachment mechanism for temporarily affixing the grip device to the electronic device or to the protective case.

A grip device further comprising an attachment mechanism for removably attaching the grip device to the protective case.

A grip device wherein the attachment mechanism includes an adhesive.

A grip device wherein the attachment mechanism includes one or more magnets.

A grip device wherein the grip device removably snaps into the protective case.

A grip device wherein the cap is further adapted to act as a stand when in the extended position to hold the electronic device in a viewing position.

A grip device wherein the bendable material is a plastic film.

A grip device wherein the extended cap, the base, and the bendable straps form an opening for receiving one or more fingers of a user.

A grip apparatus for facilitating holding of an electronic device, the grip apparatus comprising: a base configured for attachment to the electronic device or for attachment to a protective case for the electronic device; two straps each formed from a bendable material, wherein each strap includes a first end and a second end, wherein the first end of each strap is attached to the base; and a cap configured to assist a user in holding the electronic device and/or the protective case for the electronic device, wherein the cap is proximate a top surface of the base when in a stowed position, wherein the cap is extendable away from the top surface of the base away from the electronic device and/or the protective case when the cap is pulled outward to extend the cap to an extended position, wherein each bendable strap is configured to slide, at least partially, within a slot in the cap, wherein the second end of each bendable strap slides into the slot when the grip apparatus is transitioned to the stowed position and slides out of the slot when the grip apparatus is transitioned to the extended position, and wherein a stop at the second end of each strap establishes a maximum extension length and prevents the strap from fully exiting the slot of the cap.

A grip apparatus wherein the grip apparatus is rotatable relative to the electronic device and/or the protective case.

A grip apparatus wherein each of the straps is substantially planar when in a relaxed state.

A grip apparatus wherein each of the straps must bend to slide into and out of the slot in the cap when transitioning between positions.

A grip apparatus wherein the straps are attached to opposing sides if the base.

A grip apparatus wherein the straps enter the slot on opposing sides of the cap.

A grip apparatus of wherein the slot is two slots.

A grip apparatus wherein the slot is one slot and the straps slide in opposite directions in the slot.

A grip apparatus wherein the slot includes a divider that divides a least a portion of the slot into two areas.

A grip apparatus wherein each of the straps slides in the slot on an opposite side of the divider from the other strap.

A grip apparatus further comprising an attachment mechanism for temporarily affixing the grip apparatus to the electronic device or to the protective case.

A grip apparatus further comprising an attachment mechanism for removably attaching the grip apparatus to the protective case.

A grip apparatus wherein the attachment mechanism includes an adhesive.

A grip apparatus wherein the attachment mechanism includes one or more magnets.

A grip apparatus wherein the grip apparatus removably snaps into the protective case.

A grip apparatus wherein the grip apparatus is inserted into the protective case from an interior of the protective case.

A grip apparatus wherein the cap is further configured to act as a stand when in the extended position to hold the electronic device in a viewing position.

A grip apparatus wherein the bendable material is a plastic film.

A grip apparatus wherein the two straps are formed from a single piece of material.

A grip apparatus wherein the extended cap, the base, and the bendable straps form an opening for receiving one or more fingers of a user.

Various components described herein may be manufactured, provided, or sold in the form of a system or a kit. The system or kit may include any combination of: a protective case or cover having any combination of the features described herein and a compatible device grip, or multiple compatible device grips or components. The system or kit need not include every component or feature described herein.

The elements, components, and steps described herein are meant to exemplify some types of possibilities. In no way should the aforementioned examples limit the scope of the invention, as they are only exemplary embodiments.

The phrases "in some embodiments," "according to some embodiments," "in the embodiments shown," "in other embodiments," "in some examples," "in other examples," "in some cases," "in some situations," "in one configuration, " "in another configuration," and the like generally mean that the particular technique, feature, structure, or characteristic following the phrase is included in at least one embodiment of the present invention and/or may be included in more than one embodiment of the present invention. In addition, such phrases do not necessarily refer to the same embodiments or to different embodiments.

The foregoing disclosure has been presented for purposes of illustration and description. Other modifications and variations may be possible in view of the above teachings. The embodiments described in the foregoing disclosure were chosen to explain the principles of the concept and its practical application to enable others skilled in the art to best utilize the invention. It is intended that the claims be construed to include other alternative embodiments of the invention except as limited by the prior art.

What is claimed is:

1. A grip system configured for assisting holding of an electronic device, the grip system comprising:

a protective case comprising a protective shell for receiving the electronic device and covering at least a portion of a housing of the electronic device, the protective case having a back surface having a recess, wherein the recess in the back surface includes an opening having a circular shape and a portion that extends from the opening under a lip of the protective case; and a grip apparatus that is removably attachable to the back surface of the protective case, the grip apparatus comprising:

a base configured to be removably inserted into the recess in the back surface of the protective case for removably attaching the grip apparatus to the protective case, wherein the base has a circular shape having a diameter that is larger than a diameter of the opening in the protective case;

two flexible strips each formed from a bendable material, wherein each flexible strip includes a first end and a second end, wherein the first end of each flexible strip is attached to the base; and a cap configured to assist a user in holding the protective case, wherein the cap is proximate a top surface of the base when in a stowed position, wherein the cap is extendable away from the top surface of the base and away from the protective case when the cap is pulled outward to extend the cap to an extended position, wherein each flexible strip is configured to slide, at least partially, within a slot in the cap, wherein each flexible strip slides into the slot when the grip apparatus is transitioned to the stowed position and slides outward from the slot when the grip apparatus is transitioned to the extended position, and wherein a stop proximate the second end of each flexible strip establishes a maximum extension length and prevents the respective flexible strip from fully exiting the slot of the cap.

2. The grip system of claim 1 wherein the grip apparatus is rotatable relative to the protective case and rotatable while remaining attached to the protective case.

3. The grip system of claim 1 wherein each flexible strip is substantially planar when the grip apparatus is in the stowed position, and wherein each flexible strip must bend to slide into and out of the slot in the cap when transitioning the grip apparatus between the stowed position and the extended position.

4. The grip system of claim 1 wherein the slot in the cap is two slots and each of the flexible strips slides in a separate one of the two slots in the cap.

5. The grip system of claim 1 wherein the base is configured to temporarily deform when an external force is applied such that the base temporarily fits through the diameter of the opening and into the recess of the protective case.

6. The grip system of claim 5 wherein the base is configured to relax to the original diameter of the base when the external force is removed such that the base extends under the lip thereby attaching the grip apparatus to the protective case.

7. The grip system of claim 5 wherein the circular shape of the base includes a gap in the circular shape of the base, wherein the gap is configured to facilitate the deformation when the external force is applied.

8. The grip system of claim 1 wherein the cap of the grip apparatus is substantially flush with the back surface of the protective case when the grip apparatus is in the stowed position.

9. The grip system of claim 1 wherein the cap is further configured to serve as a stand for the protective case when the grip apparatus is in the extended position or in a partially extended position.

10. The grip system of claim 1 wherein the cap and the flexible strips are configured for receiving one or more fingers of a user for holding the grip apparatus and the protective case when the grip apparatus is in the extended position.

11. A grip configured for assisting in holding of an electronic device installed in a protective case having a circular opening having a first diameter in a back surface of the protective case, the grip comprising:

a base configured to be removably inserted into a recess in a back surface of the protective case for removably affixing the grip to the protective case, wherein the base has a circular shape having a second diameter that is larger than the first diameter;

two flexible straps each formed from a resilient material, wherein each flexible strap includes a first end and a second end, wherein the first end of each flexible strap is attached to the base; and a cap configured to assist a user in holding the protective case, wherein the cap is proximate a top surface of the base when the grip is in a stowed position, wherein the cap is extendable away from the top surface of the base away from the protective case when the cap is pulled outward to extend the cap to an extended position, wherein each flexible strap is configured to slide, at least partially, within a slot in the cap, wherein each flexible strap slides into the slot when the grip is transitioned to the stowed position and slides outward from the slot when the grip is transitioned to the extended position, and wherein a stop proximate the second end of each flexible strap defines a maximum extension length and prevents the respective flexible strap from fully exiting the slot of the cap.

12. The grip of claim 11 wherein the slot in the cap is two slots and each of the flexible straps is configured to slide in a separate one of the two slots in the cap.

13. The grip of claim 11 wherein the base is configured to temporarily deform when an external force is applied to the base such that the deformed base temporarily fits through the first diameter.

14. The grip of claim 13 wherein the base is configured to relax to the second diameter when the external force is removed such that the base extends under the lip thereby attaching the grip to the protective case.

15. The grip of claim 11 wherein the cap of the grip is substantially flush with the back surface of the protective case when the grip is in the stowed position.

16. The grip of claim 11 wherein the cap is further configured to serve as a stand for the protective case when the grip is in the extended position or in a partially extended position.

17. The grip of claim 11 wherein the cap and the flexible straps are configured for receiving one or more fingers of a user for holding the grip and the attached protective case when the grip is in the extended position.

* * * * *